United States Patent [19]

Oguri

[11] Patent Number: 4,864,907

[45] Date of Patent: Sep. 12, 1989

[54] AUTOMATIC BASS CHORD ACCOMPANIMENT APPARATUS FOR AN ELECTRONIC MUSICAL INSTRUMENT

[75] Inventor: Shigenori Oguri, Hamamatsu, Japan

[73] Assignee: Yamaha Corporation, Hamamatsu, Japan

[21] Appl. No.: 13,249

[22] Filed: Feb. 10, 1987

[30] Foreign Application Priority Data

Feb. 12, 1986 [JP] Japan ..... 61-28373

[51] Int. Cl.[4] ..... G10F 1/00; G10H 1/38

[52] U.S. Cl. ..... 84/637; 84/650; 84/DIG. 22; 84/715

[58] Field of Search ..... 84/1.01, 1.03, 1.17, 84/1.24, DIG. 12, DIG. 22

[56] References Cited

U.S. PATENT DOCUMENTS

| | | | |
|---|---|---|---|
| 3,795,755 | 3/1974 | Uchiyama | 84/1.03 X |
| 4,144,788 | 3/1979 | Bione et al. | 84/1.03 X |
| 4,184,401 | 1/1980 | Hiyoshi et al. | 84/1.03 |
| 4,204,453 | 5/1980 | Gross | 84/1.03 |
| 4,216,692 | 8/1980 | Okuyama et al. | 84/1.03 X |
| 4,381,689 | 5/1983 | Oya | 84/1.01 |
| 4,472,992 | 9/1984 | Okuma et al. | 84/1.03 |

FOREIGN PATENT DOCUMENTS

| | | | |
|---|---|---|---|
| 0039464 | 11/1981 | European Pat. Off. | 84/1.03 |
| 05715400 | 3/1982 | Japan | 84/1.03 |

*Primary Examiner*—A. T. Grimley
*Assistant Examiner*—John G. Smith
*Attorney, Agent, or Firm*—Spensley Horn Jubas & Lubitz

[57] ABSTRACT

An electronic musical instrument having automatic bass chord accompaniment performance in which bass tones are generated in different manners depending on the state of the keyboards of the device. Chord and bass notes are selected using lower and pedal keyboards, respectively. The chord type and root note are identified from the depressed keys of the keyboards. The bass tone is generated with consideration of whether the identified root note coincides with the selected bass note. In the situation where the root note coincides with the bass note, a bass tone is generated based on a stored predetermined bass pattern corresponding to the particular chord type and root note identified. In the situation where the root note does not coincide with the bass note, or if a chord type has not been identified, a bass tone is generated based on the depressed bass note key.

3 Claims, 16 Drawing Sheets

| VALUES OF ROOT NOTE DATA | ROOT NOTES |
|---|---|
| 0 | C |
| 1 | C# |
| 2 | D |
| 3 | D# |
| 4 | E |
| 5 | F |
| 6 | F# |
| 7 | G |
| 8 | G# |
| 9 | A |
| A | A# |
| B | B |
| C | INDEFINITE |

| VALUES OF TYPE DATA | CHORD TYPES |
|---|---|
| 0 | M |
| 1 | 6 th |
| 2 | M7 |
| 3 | +5 |
| 4 | -5 |
| 5 | m |
| 6 | m6 |
| 7 | mM7 |
| 8 | 7th |
| 9 | $7^{+5}$ |
| A | $7^{-5}$ |
| B | $7_{SUS4}$ |
| C | m7 |
| D | $m7^{-5}$ |
| E | dim |
| F | NOT-ESTAB-LISHED |

FIG. 4

| VALUES OF NOTE DURATION DATA | VALUES OF CLOCK COUNT DATA |
|---|---|
| 0 | 1 |
| 1 | 2 |
| 2 | 4 |
| 3 | 6 |
| 4 | 8 |
| 5 | 10 |
| 6 | 12 |
| 7 | 16 |
| 8 | 20 |
| 9 | 24 |
| A | 28 |
| B | 32 |
| C | 38 |
| D | 44 |
| E | 68 |
| F | 92 |

FIG. 5

| PITCHES | 00 | 01 | 02 | 03 | | 1E | 1F |
|---|---|---|---|---|---|---|---|
| SEMITONE NUMBERS | 43 | 45 | 47 | 48 | | 78 | 79 |

$T_C$ $T_B$ (MAJOR)

AS MANY AS CHORD TYPES

AUTOMATIC BASS CHORD ACCOMPANIMENT APPARATUS FOR AN ELECTRONIC MUSICAL INSTRUMENT

BACKGROUND OF THE INVENTION (a) Field of the invention

The present invention relates to an automatic accompaniment apparatus for automatic bass chord (ABC) performances in or for an electronic musical instrument, and more particularly to an improvement of the automation accompaniment apparatus of the type designed to detect a chord type such as major, minor and so forth based on the state of key depression on the manual and pedal keyboards to thereby control the generation pattern of bass chord tones.

(b) Description of the prior art

In the past, as the automatic accompaniment apparatuses for automatic bass chord performances, there is known the apparatus arranged so that the root note and the type of the chords are designated on the manual keyboard, and along therewith a desired note is designated on the pedal keyboard, to thereby realize a bass chord performance (e.g. see U.S. Pat. No. 4,184,401). In this prior art apparatus, arrangement is provided so that the tones of a triad or a four-note chord, each containing the root note of the chord, are generated is the chord tones in accordance with a chord pattern corresponding to the designated chord type, whereas as a tone (bass root note) designated on the pedal keyboard and another tone (subordinate tone) of a predetermined interval (e.g. minor 3rd, perfect 5-th, etc.) relative to the bass root note are generated as the bass tones in accordance with the bass pattern corresponding to the designated chord type.

As another automatic accompaniment apparatus of the prior art, there is known the arrangement that the chord is detected based on the state of key depressions on both the manual and pedal keyboards, and that the note name designated on the pedal keyboard is utilized as the root note to thereby realize a bass chord performance.

In this latter prior art apparatus, chord tones are generated in the form of a triad or a four-note chord in accordance with the chord pattern corresponding to the detected chord type respectively containing a root note, whereas as the bass tone, there are generated a root note and its related subordinate notes in accordance with the bass pattern corresponding to the detected chord type.

In such an automatic accompaniment apparatus of the prior art as described above designed so that the root note of a chord and the type of this chord are designated on the manual keyboard and that an arbitrary note is designated on the pedal keyboard, it is possible to enjoy a bass progression rich in variation by designating, by the use of the pedal keyboard, a bass root note which differs in note name from the chord root note designated on the manual keyboard. However, the above-mentioned prior art apparatus is entailed by the inconvenience that, at the time of bass tone progression, there is generated bass tones which is discord relative to the chord tones which are produced. For example, let us here assume that C-major is designated on the manual keyboard and a bass root note B is designated on the pedal keyboard. Whereupon, a triad consisting of C-E-G is generated as the chord tones in accordance with the chord pattern for the major chord, and along therewith, the bass tones which consist of B and F# notes are generated in accordance with the bass pattern in the major mood, so that the F# bass tone is not in harmony with the chord tones of C-major.

On the other hand, in the automatic accompaniment apparatus described above which is designed so that the chord type is detected based on the state of key depressions on both the manual and pedal keyboards and that the note name designated on the pedal keyboard is utilized as the root note, the performer is unable to designate a bass root note which differs in note name from the root note of the chord, so that the apparatus is unable to realize the so-called "non-root-bass chord" performances.

Here, the term "non-root-bass chord performance" points to a performance such that, while generating a specific note as the bass tone, chord tones containing a root note which differs in note name from said specific bass tone are generated. For example, the non-root-bass chord "$C_{7th}$/E" ($C_7$ on E) generates a note E as the bass tone and also a four-note chord of $C_{7th}$ as the chord tones. Even when the player designates C, E, G and Bb on the manual keyboard while designating the note E on the pedal keyboard in order to make such a performance as mentioned above, the apparatus per se will play in such a way that the chord is performed with the chord pattern for the seventh using "E" as the root note, and that the bass is performed with the bass pattern for the seventh on the root note "E". Therefore, after all, the performance plunges into a bass chord performance for "$E_{7th}$".

SUMMARY OF THE INVENTION

It is, therefore, an object of the present invention to provide an automatic accompaniment apparatus in or for an electronic musical instrument having manual as well as pedal keyboards, which apparatus not only allows regular automatic bass chord performances wherein the bass tone of the depressed pedal key serves as the root note of the chord designated by the manual keyboard, but also allows automatic bass chord performances wherein the tone of the depressed pedal key does not serve as the root note of the chord designated by the manual keyboard.

Another object of the present invention is to provide an automatic accompaniment apparatus as mentioned above, which allows automatic bass chord performances of "non-established chord pattern", i.e. based on a specifically prepared chord pattern, with the bass tone being of the note of the depressed pedal key and being produced, with a memorized rhythm pattern.

Still another object of the present invention is to provide an automatic accompaniment apparatus as mentioned above, which allows non-root-bass chord performances without producing an unintentional discord.

Yet another object of the present invention is to provide an automatic accompaniment apparatus as mentioned above, which allows automatic bass chord performances of the so-called tension chord.

According to the present invention, the above-mentioned objects are attained by the provision of an automatic accompaniment apparatus, as functionally shown in FIG. 1, which is provided with a first keyboard (A) for manual key operation and a second keyboard (B) for pedal key operation, and having a first (C) and a second (D) detecting means, chord tone generating means (E), judging means (F), and bass tone generating means (G). Excluding the first and second keyboards, the abovementioned parts are assigned with the roles as mentioned below.

The first detecting means (C) is intended to detect the chord type based on the key depression informations supplied from the first and second keyboards (A) and (B). The second detecting means (D) is intended to detect the root note based on the key depression information delivered from at least the first keyboard (A) or from both keyboards (A) and (B).

The chord tone generating means (E) is intended to generate chord tones based on the selected chord pattern according to the detected chord type and on the detected root note.

The judging means (F) is to judge whether there is coincidence in note name between the key depressed on the second keyboard (B) and the detected root note. Depending on whether the result of this judgment is affirmative or negative, the manner of bass tone generation varies.

More particularly, the bass tone generating means (G) mentioned above is operative in such a way that, whenever, there is established coincidence in note name between the above-mentioned two notes, it generates bass tones in a walking bass fashion (melodic bass movement exhibiting a chord feeling) based on the bass pattern memorized and corresponding to the detected chord type and also on the detected root note name, whereas when there is established no coincidence therebetween, it generates a bass tone (non-walking) corresponding to the key depressed on the second keyboard (B). Although it is possible to generate the bass tone for the depressed key on the second keyboard (B) at timings indicated by the bass pattern memorized and corresponding to the detected chord type, the bass tone may be generated by exactly following the key operations on the second keyboard (B).

In the above-mentioned automatic accompaniment apparatus, it should be noted here that, for cases where the chord type cannot be detected by the first detecting means (C) (i.e. in case of non-establishment of a chord), there may be provided a third detecting means (H) intended to detect a chord type based on the key depression information coming from the first keyboard (A) only.

In case such an arrangement is provided, generation of chord tones by the chord tone generating means is carried out in a manner as mentioned above whenever the chord type is detected (when a chord is established) by the first detecting means; but if a chord is not established, the generation of chord tones is carried out based on the chord pattern corresponding to the chord type detected by the third detecting means (H) and also on the root note detected by the second detecting means (D). On the other hand, the judging means (F) makes such a judgment as mentioned above when a chord is established. The bass tone generating means (G) carries out such a bass tone generation as mentioned above in accordance with the result of this judgment. In case of non-establishment of a chord, the bass tone generating means (G) generates a bass tone corresponding to that key depressed on the second keyboard (B), in a manner same as that for the above-described case of non-coincidence in note name.

According to the arrangement of the automatic accompaniment apparatus of the present invention, the user is allowed to designate by the second keyboard (B) a tone which differs in note name from the root note of the chord, so that a non-root-bass chord performance is feasible. For example, in case it is intended to perform a non-root-bass chord "$C_{7th}$/E", the player designates C, E, G and Bb on the first keyboard, while he designates the note "E" on the second keyboard. Whereupon, the "seventh" is detected as the chord type, whereas the note "C" is detected as the root note of the chord. Therefore, the result of judgment concerning the coincidence in note name will become negative. For this reason, a chord is performed based on the note "C" as its root note and in the chord pattern for the "seventh", while the note "E" is generated as the bass tone. In this case, however, no bass movement (melodic walk) is performed, so that, there, occurs no generation of a tone which is unintentionally in discord with the chord tones. Also, the apparatus allows the player to alter keys to be depressed on the second keyboard (B) while fixing the chord per se. Therefore, it is possible for the user to make such a manner of playing that the bass tone alone is moving, i.e. the so-called walking bass playing.

It should be noted here that, in the above-stated example, if the note "C" is designated on the second keyboard (B) instead of designating the note "E", the judgment will become affirmative. In this case, a bass chord for "$C_{7th}$" is performed in a regular manner as by a certain type of the conventional apparatus.

As has been described above, in case the third detecting means (H) is provided, detection of a chord is made based only on the state of key depressions on the first keyboard (A), so that it becomes possible to realize a performance by detecting, for example, a tension chord which is peculiar to the manual keyboard, in addition to such a basic chord as triad or four-note chord including the seventh. Here, the term "tension chord" means a chord which is obtained by adding a tension note (a note serving the role of tension) to a basic chord and excluding the specific note into which this tension note is to resolve. For example, it may be chord obtained by adding, to "$C_{7th}$", a "9th" note as the tension note and excluding the root note "C", i.e. making "$C_{7th}$(9th)". In case a tension note is added, a strong sense of tension is imparted to the sound which is outputted, making the presentation of tones much richer and pleasant.

As an example, in order to perform a tension chord "$C_{7th}$(9th)", a chord excluding the root note "C" and added with the "9th" note is designated on the first keyboard (A), and along therewith the root note "C" is designated on the second keyboard (B). By so doing, the first detecting means (C) makes the judgment "non-establishment of a chord", whereas the third detecting means (H) detects a tension chord. And, the chord tone generating means (E) generates chord tones in accordance with the chord pattern corresponding to the tension chord detected by the third detecting means (H), and the bass tone generating means generates the root note "C".

These as well as other objects and advantages of the present invention will become apparent from the following detailed description of the preferred embodiments thereof when taken in conjunction with the accompanying drawings and appended claims.

BRIEF DESCRIPTION OF THE DRAWINGS

FIG. 4 is an illustration showing the memory contents of the chord table in association with root note and chord type.

FIG. 5 is an illustration showing the memory contents of the note duration-to-clock count conversion table in association with the values of note duration data.

DETAILED DESCRIPTION OF THE PREFERRED EMBODIMENTS

Figure 1:
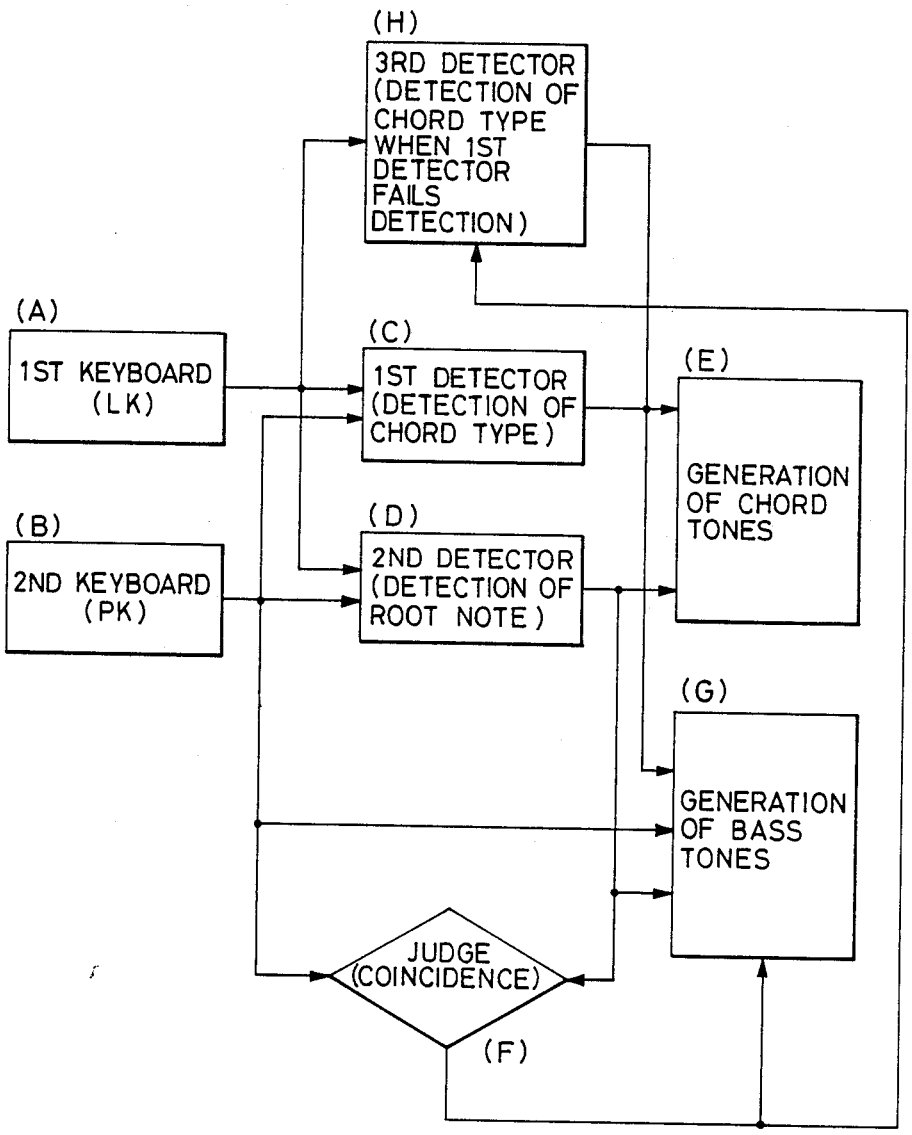
FIG. 1 is a functional block diagram showing the general concept of the automatic accompaniment apparatus of the present invention.
Figure 2:
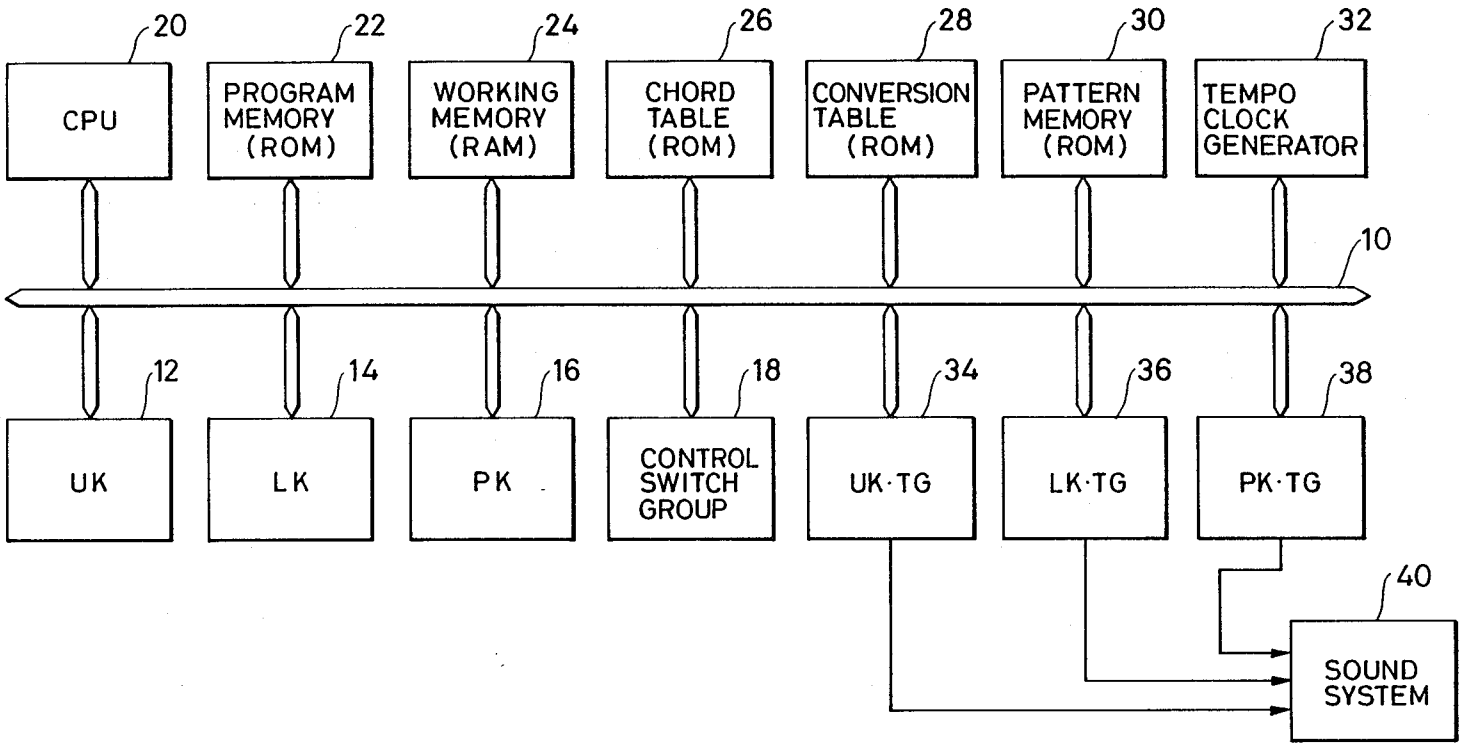
FIG. 2 is a block diagram showing the circuit arrangement of an electronic musical instrument equipped with the automatic accompaniment apparatus according to an embodiment of the present invention.

FIG. 2 shows the circuit arrangement of an electronic musical instrument provided with an automatic accompaniment apparatus according to an embodiment of the present invention. In this electronic musical instrument, arrangement is so provided that the generation of various kinds of musical tones such as melody tones, chord tones, bass tones and rhythm tones can be controlled by means of a microcomputer.

Description will be made hereunder of the following items with respect to the electronic musical instrument of this embodiment.

Figure 16:
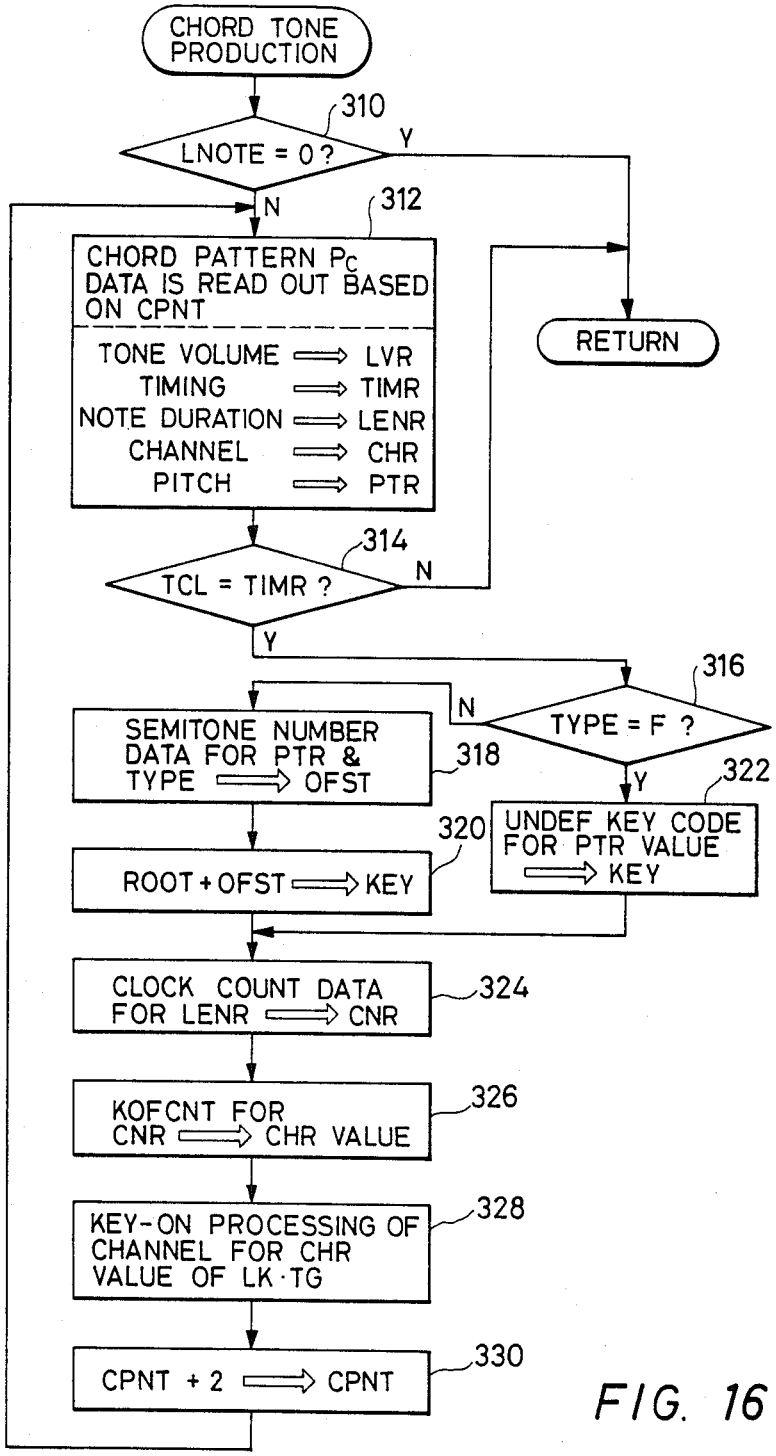
FIG. 16 is a flow chart showing the chord tone production sub-routine.
Figure 17:
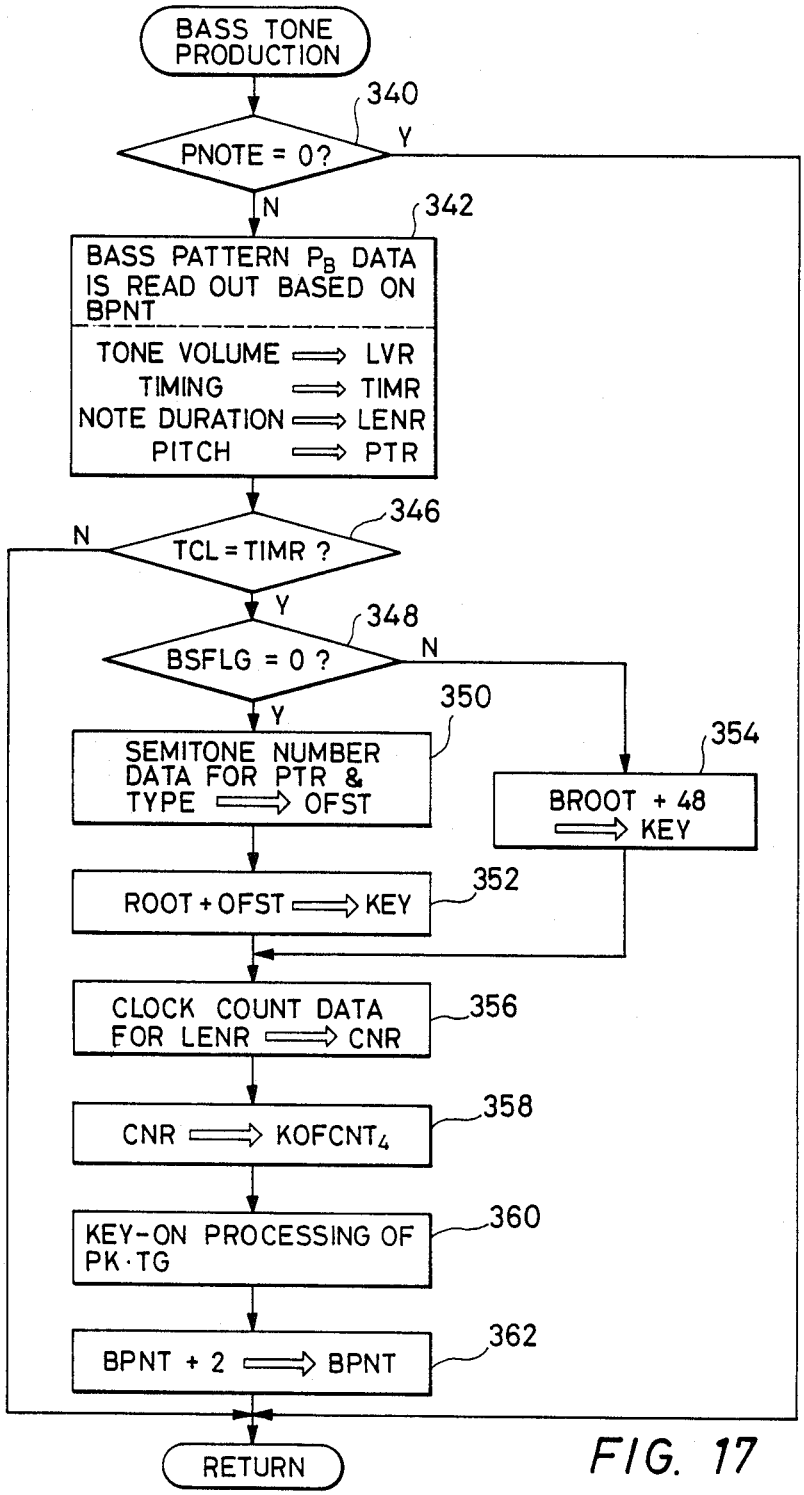
FIG. 17 is a flow chart showing the bass tone production sub-routine.

(A) Circuit arrangement (FIG. 2)
(B) Outline of control of bass chord tone generation (FIG. 3)
(C) Chord table (FIG. 4)
(D) Conversion table (FIGS. 5 and 6)
(E) Pattern memory (FIGS. 7 and 8)
(F) Registers used in working memory
(G) Calculation formulas
(H) Main routine (FIG. 9)
(I) Key processing sub-routine (FIG. 10)
(J) Chord detection sub-routine (FIGS. 11 and 12)
(K) Key code setting sub-routine (FIG. 13)
(L) Interrupt routine (FIG. 14)
(M) Bass chord tone generation suspension sub-routine (FIG. 15)
(N) Chord tone production sub-routine (FIG. 16)
(0) Bass tone production sub-routine (FIG. 17)

(A) Circuit arrangement (FIG. 2)

To a bus 10 are connected an upper keyboard (UK) 12, a lower keyboard (LK) 14, a pedal keyboard (PK) 16, a control switch group 18, a central processing unit (CPU) 20, a program memory 22, a working memory 24, a chord table 26, a conversion table 28, a pattern memory 30, a tempo clock generator 32, a UK tone generator (UK.TG) 34, an LK tone generator (LK.TG) 36 and a PK tone generator (PK.TG) 38.

Both UK 12 and LK 14 are manual keyboards. Usually, UK 12 is utilized for melody performances and LK 14 for chord performances. PK 16 is a pedal keyboard, which is used for bass performances. For the keys of UK 12, LK 14 and PK 16, key codes are so predetermined for each key thereof as enumerated below.

Keys: C $C\#_1$ . . . $B_1C_2$ . . . $C_3$ . . . $C_4$ . . . $C_5$ . . . $C_6$ . . . $C_7$ Key codes: 24 25 . . . 35 36 . . . 48 . . . 60 . . . 72 . . . 84 . . . 96

The control switch group 18 includes various kinds of control switches for both tone control and performance control. For the practicing of the present invention, however, the control switch group further includes a rhythm start switch, rhythm kind selection switches and like switches.

The CPU 20 is intended to carry out various control processing for the generation of various kinds of musical tones in accordance the program stored in the program memory 22 which is comprised of a ROM (Read Only Memory). The details of these various kinds of control processing will be described later by referring to FIGS. 9 to 17.

The working memory 24 is formed with a RAM (Random Access Memory), and includes memory regions which are utilized to serve as counters, flags, registers and so forth at the time various kinds of processing are carried out through CPU 20. Among these memory regions, those which are used for the control of bass chord tones will be described later.

The chord table 26 is composed of a ROM which stores root note data indicative of root notes and also of type data representating chord types (kinds of chords), and this chord table is used for the detection of chords. The contents stored in this chord table 26 will be described later by referring to FIG. 4.

The conversion table 28 is comprised of a ROM, and includes a tone duration-to-clock count conversion table and also a pitch-semitone number conversion table. The memory contents of these conversion tables will be described later by referring to FIGS. 5 and 6.

Pattern memory 30 is composed of a ROM storing paired bass patterns and chord patterns in an amount corresponding to the chord types. The contents of memory thereof will be described later by referring to FIGS. 7 and 8.

Tempo clock generator 32 is intended to generate tempo clock pulses. Respective tempo clock pulses are utilized as the interrupt command signals for starting the interrupt routine mentioned in FIG. 14.

UK.TG 34 is intended to generate musical tone signals (usually melody tone signals) based on the key operations on UK 12. Also, LK.TG 36 and PK.TG 38 are tone generators for automatic bass chord (ABC) performances, and they are to generate chord tone signals and bass tone signals, respectively, as controlled by CPU 20.

Sound system 40 is intended to convert the musical tone signals supplied from UK.TG 34, LK TG 36 and PK.TG 38, to sounds.

(B) Outline of bass chord tone generation control

Figure 3:
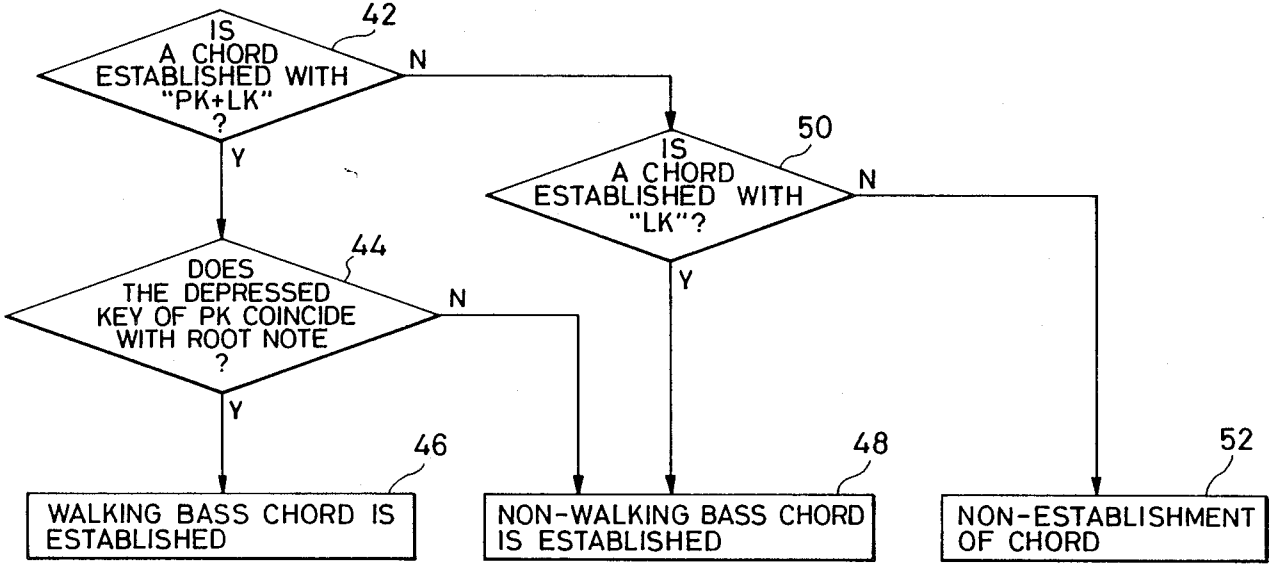
FIG. 3 is a flow chart for explaining the outline of bass-chord tone generation control in the above-mentioned electronic musical instrument.

FIG. 3 schematically illustrates the behavior of bass chord tone generation control in the above-mentioned electronic musical instrument.

In Step 42, a chord type is detected based on the key depression informations delivered from LK 14 and PK 16, and judgment is made whether or not a chord is established. If the result of this judgment indicates "establishment of chord", (Y), processing moves to Step 44, wherein judgment is made whether there is coincidence in note name between the depressed key on the PK 16 and the root note detected separately.

If the result of this judgment in Step 44 indicates "coincidence of note names", (Y), processing moves onto Step 46, wherein processing "establishment of chord for bass progression" is carried out. In this processing, chord tones are generated based on the chord pattern corresponding to the detected chord type and also on the detected root note, and along therewith a bass tone is generated based on the bass pattern corresponding to the detected chord type and also on the detected root note.

In case the result of judgment in Step 44 indicates "non-coincidence of note names", (N), processing advances to Step 48, wherein processing "establishment of chord for non-progression of bass " is carried out. In this processing, chord tones are generated in a manner similar to that of Step 46. However, as the bass tone, a tone corresponding to the key depressed on PK 16 is generated at timings indicated by the bass pattern corresponding to the detected chord type. That is, in this case, no bass progression such as the generation of subordinate tones is carried out.

On the other hand, in case the judgment in Step 42 indicates "non-establishment of chord", (N), processing moves to Step 50, wherein chord type is detected based on the key depression information supplied from LK 14, to thereby make a judgment as to whether or not a chord is established. If the result of this judgment indicates "establishment of a chord", (Y), processing moves to Step 48, wherein processing similar to that for the abovedescribed "non-coincidence of note names" is carried out.

Also, in case the judgment in Step 50 indicates "non-establishment of chord", (N), processing moves to Step 52, wherein processing for "non-establishment of chord" is carried out. In this processing, either a single or a plurality of tones whose note name or names is or are identical with the key or keys depressed on LK 14 is or are generated in accordance with the specific chord pattern which is intended for use exclusively in case of "non-establishment of chord", and along therewith the tone of the depressed key on PK 16 is generated at timings indicated by the specific bass pattern for "nonestablishment of chord".

By passing through Steps 42, 44 and 46, bass chord performances similar to the conventional performances are feasible. Also, by passing through Steps 42, 44 and 48, it is possible to realize non-root-bass chord performances and walking bass performances. Furthermore, by passing though Steps 42, 50 and 48, tension chord performances are available.

(C) Chord table (FIG. 4)

FIG. 4 shows the memory contents of the chord table 26 by way of their relationship with root notes and chord types. The values of root note data and of the type data are expressed in hexadecimal notation, respectively. The chord table 26 is intended to convert 12-bit address data to 8-bit chord name data (i.e. 4-bit root note data and 4-bit typedata). Let us here denote the "12 bits" of the address data by $b_0 \sim b_{11}$ in successive reversive order from the least significant bit (LSB). Whereby, the respective bits correspond to the twelve (12) note names as mentioned below. For each bit, "0" indicates "no key depression" and "1" signifies "key depressed".

Bits: $b_{11}$ $b_{10}$ $b_9$ $b_8$ $b_7$ $b_6$ $b_5$ $b_4$ $b_3$ $b_2$ $b_1$ $b_0$ Note names: B A# A G# G F# F E D# D C# C In case, as an example, keys C-E-G are depressed, address data will become "000010010001". Converting this data by the chord table 26, there is obtained a chord name datum "00" serving as an output datum. This specific chord datum signifies $C_M$ (C major).

In case, as another example, keys A-C-G are depressed, the address data will become "001010000001". By converting this data through the chord table 26, a chord name datum "9C" is obtained to serve as an output datum. This chord name datum indicates $A_{m7}$ (A minor seventh).

(D) Conversion table (FIGS. 5 and 6)

FIG. 5 shows the memory contents of the note duration-to-clock count conversion table stored in the conversion table 28 in their association with the values of the note duration data. The note duration data are 4-bit data contained in the pattern data which will be described later by referring to FIG. 8, and they assume either one of the values 0, 1, 2, . . . , F in hexadecimal notations. Also, clock count (number) data signify the note duration (length of the period of pronunciation) by the number of the above-mentioned tempo clock pulses.

The note duration data are converted to corresponding clock count (number) data through the conversion table shown in FIG. 5. For example, the note duration datum "5" is converted to the clock count datum "10", and the note duration datum "A" is converted to the clock count datum "28".

Figures 6A, 6B:
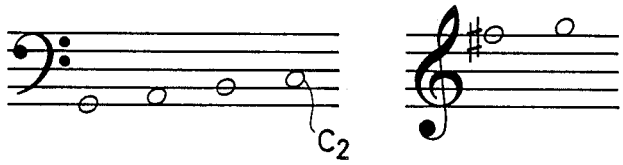
FIG. 6A is an illustration showing the memory contents of the pitch-to-semitone number conversion table.
FIG. 6B is an illustration showing chord-constituent notes which can be sounded out in case the chord type is $C_{major}$ ($C_M$).

FIG. 6A shows the memory contents of the pitch-to-semitone number conversion table in the conversion table 28. The table TC for chords and the table T8 for basses correspond to the chord type "major". In this way, each combination of two kinds of tables as a pair is stored for every chord type.

As one such example, in the chord table $T_C$ are stored such semitone number data "43"~"79" as illustrated correspondingly to the pitch data "00"~"1F", respectively in hexadecimal notations. The pitch data are 5-bit data contained in the pattern data which will be described later with respect to FIG. 7, and each bit indicates either one of the thirty-two (32) pitch levels "00"~"1F". In this case, the pitch level "03" corresponds to the root tone "C". Also, semitone count data represent tone pitches by semitone counts (numbers). The semitone counts are so predetermined as to coincide with the key code values of tones which are to be sounded out when the root note is set to "C" (when the root note datum value is "0"), in such a way that, in case of, for example, "$C_2$" tone, the semitone counts is "48".

In case "major" is designated as the chord type, the pitch datum is converted to a corresponding semitone count datum through the table $T_C$ intended for chords. By adding a root note datum to the abovesaid semitone count datum, there is formed a key code datum of the tone which is to be produced. For example, if the root note is assumed to be "C", it is possible to produce such chord-constituting tones as shown in FIG. 6B. If the root note is "D", the respective tones shown in FIG. 6B will have a pitch higher by two (2) semitone counts.

Figure 7:
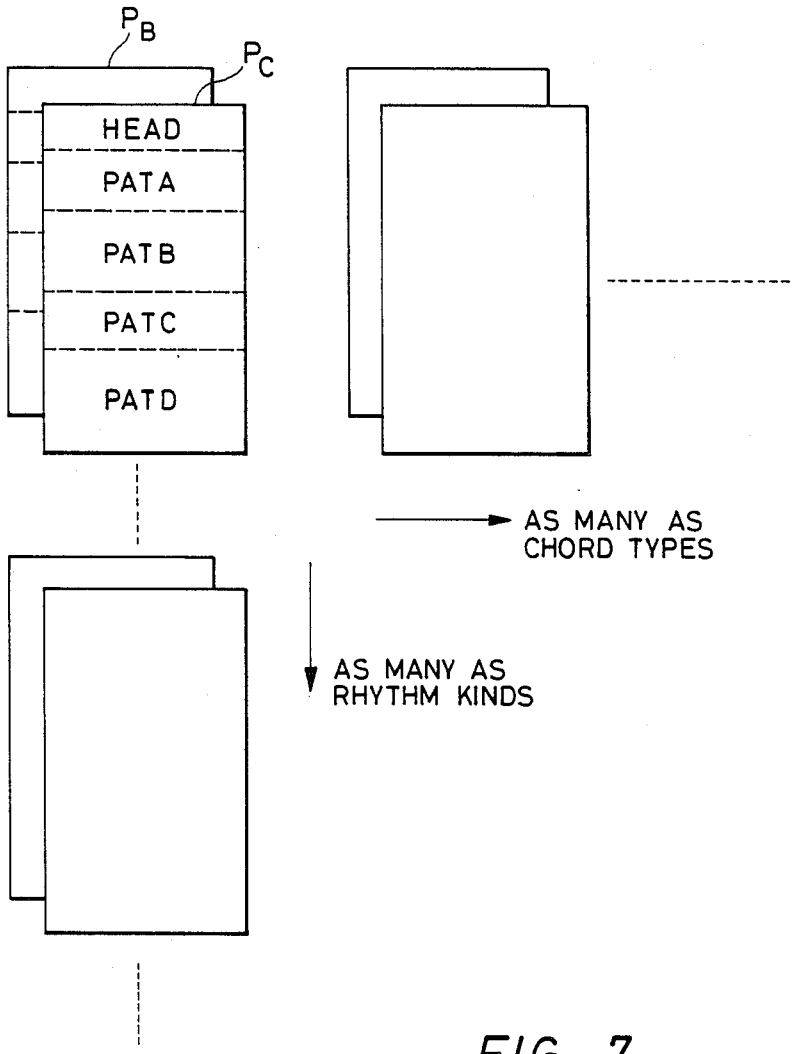
FIG. 7 is an illustration showing the memory contents of the pattern memory.
Figure 8:
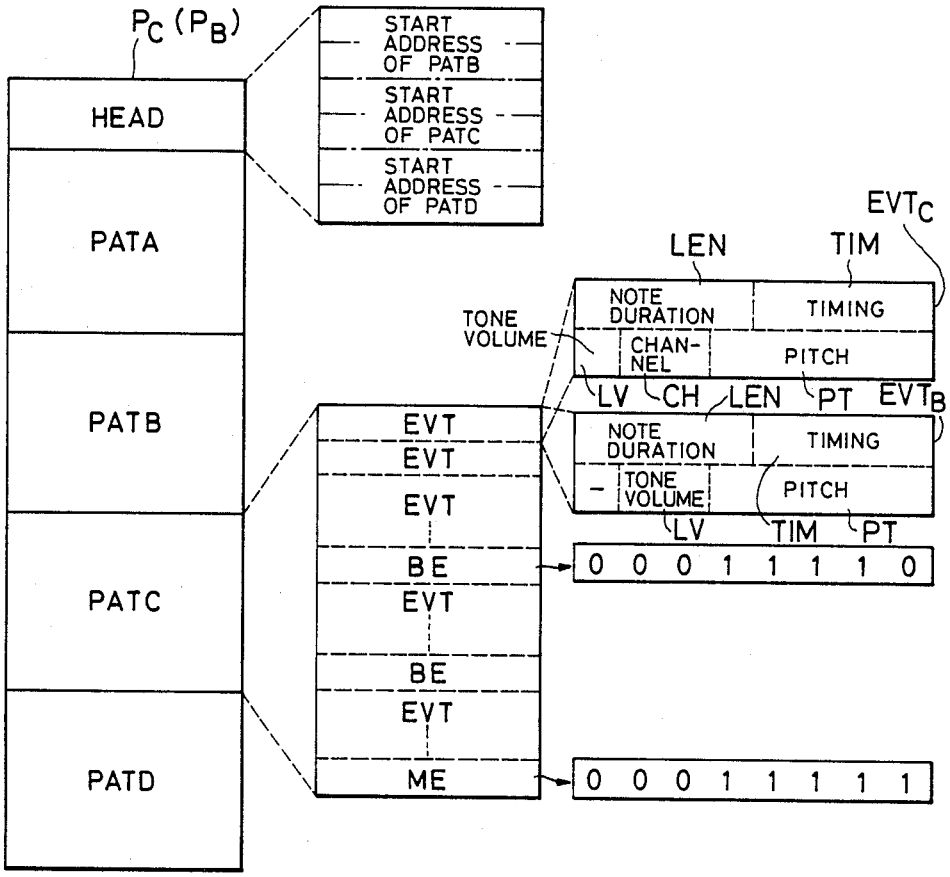
FIG. 8 is an illustration showing a pattern data format.

(E) Pattern memory (FIGS. 7 and 8)

FIG. 7 shows the memory contents of the pattern memory 30. This memory stores a plurality of paired combinations of chord pattern $P_C$ and bass pattern $P_B$ so as to correspond, respectively, to a plurality of chord types (note: "non-establishment of chord" is dealt also as an independent chord type), and along therewith this memory also stores a plurality of paired groups of such bass-chord patterns as mentioned above to correspond respectively to a plurality of rhythm kinds. It is one of the features of the present invention that different patterns are provided for different chord types.

The chord pattern $P_C$ is composed of: head data HEAD; pattern data PATA for the first, third, fifth or seventh bar (measure); pattern data PATB for the second or sixth bar; pattern data PATC for the fourth bar; and pattern data PATD for the eighth bar. This arrangement applies equally to bass pattern $P_B$ also. Here, pattern progression will be shown for both the chord pattern $P_C$ and bass pattern PB by omitting the label "PAT" from respective symbols PATA~PATD. That is, pattern progression for eight (8) bars becomes "ABACABAD". This pattern progression for eight (8) bars is to be repeated during the accompaniment performance.

FIG. 8 shows a data format of the chord pattern $P_C$ and the bass pattern $P_B$. The data format for these two kinds of patterns are to be understood to be similar with each other, excepting the slight difference in the construction of event data EVT.

Head data HEAD is a six (6)-byte data. The first two (2) bytes signify the start address of the pattern data PATB, next two (2) bytes the start address of the pattern data PATC; and the remainder two (2) bytes the start address of the pattern data PATD.

The respective pattern data are such that, as shown by way of example with respect to PATC, this latter data is composed of a successively disposed train of event data EVT, with the interposition of beat-end datum BE ("00011110") at each end of one beat, and a bar-end datum ("00011111") disposed at the end of the train of data (i.e. at the end of one bar).

Each event data $EVT_C$ in the chord pattern $P_C$ is a two (2)-byte data. Among the first byte, the more significant four (4) bits are the note duration datum LEN indicative of the length of the period of tone production, and the less significant four (4) bits are timing datum TIM indicative of the tone-producing timings; and among the second byte, the most significant bit is the tone volume (loudness) datum LV indicative of the tone volume (loudness) level; the next less significant two (2) bits are the channel datum CH indicative of the number of the tone-producing channel; and the remainder five (5) bits are the pitch datum PT indicative of pitch levels. The pitch datum PT, in the chord pattern for the "establishment of chord", assumes either one of the values "00"~"iF" in hexadecimal notation. However, in the chord pattern for "non-establishment of chord", the datum assumes either one of the values "0"~"5".

The respective event data $EVT_B$ in the bass pattern $P_B$ are similar to the event datum $EVT_C$ with respect to their first byte. With regards to the second byte, the difference over the event data $EVT_C$ lies only in the arrangement that the most significant bit indicates "non-use", and that the next less significant two (2) bits are used as the tone volume data LV. The reason why the channel data CH is not provided for the event data $EVT_B$ is that there is only one tone-producing channel for bass tones.

(F) Registers in the working memory

Among the registers of the working memory 24, those which are used for the control of bass chord tones generation are as mentioned below.

(1) Rhythm kind register RHY

This register stores rhythm kind data indicative of the rhythm kind (e.g. waltz) designated by one of the rhythm kind selection switches.

(2) Rhythm-run flag RUN

This flag is a one-bit register, and "1" is set upon turning-on the rhythm start switch, whereas when the same switch is turned off, "0" is set.

(3) Tempo clock counter CLK

This is a counter arranged so that its count value is upped by one (1) each time a tempo clock pulse is generated by the tempo clock generator 32 (i.e. each time an interrupt is applied). This counter assumes count values "0"~"95", and is reset to "0" at the timing when the count value become "96" (i.e. at the end of one bar).

(4) Intra-beat timing register $TCL_2$

This register is intended to store intra-beat timing data. The intra-beat timing data indicate either one of "0"~"23" which are the residuals obtained by dividing the count value of the tempo clock counter CLK by "24" (integral calculation). It should be noted here that, in this embodiment, one bar is a span of four (4) beats (quadruple meter).

(5) Bass chord timing register TCL

This register is intended to store bass chord timing data. The bass chord timing data indicate one half (either one of "0"~"11") of the value of the intra-beat timing data. It is possible to produce bass chord tones at timings corresponding to the values of this bass chord timing data. Production of bass chord tones at what timings is determined by the timing data TIM contained either in the event data $EVT_C$ or $EVT_B$ shown in FIG. 7.

(6) Bar counter BAR

This counter is intended to count bar numbers and assumes count values "1"~"8", and is so arranged that "1" is set at the timing when the count value becomes "9".

(7) Address pointer for chord pattern: CPNT

This pointer is used to read out the data of chord pattern $P_C$.

(8) Address pointer for bass pattern: BPNT

This pointer is used to read out the data of bass pattern $P_B$.

(9) Tone-production timing register TIMR

This register is intended to store timing data TIM.

(10) Channel register CHR

This register is intended to store channel data CH.

(11) Tone volume (loudness level) register LVR

This register is intended to store tone loudness level data LV.

(12) Pitch register PTR

This register is intended to store pitc data PT.

(13) Note duration register LENR

This register is intended to store note duration (length) data LEN.

(14) Clock count register CNR

This register is intended to store clock count data read out from the conversion table 28 in accordance with the note duration data LEN.

(15) Chord name register CHORD

This register is intended to store chord name data (4-bit note data and 4-bit type data) read out from the chord table 26.

(16) Chord type register TYPE

This register is intended to store 4-bit type data indicative of chord types.

(17) Root note register ROOT

This register is intended to store 4-bit root note data indicative of root notes.

(18) Bass root note register BROOT

This register is to store 4-bit bass root note data indicative of the note names designated by PK 16 at the time of either "non-coincidence of note names" or "non-establishment of chord".

(19) Key code register KEYCOD

This register is intended to store key code data for keys having "on" or "off" event, together with one-bit data indicative of the kind of event ("on" or "off").

(20) Key code buffers for LK $LKBUF_0 \sim LKBUF_7$

These are registers for eight (8) tones (notes) for storing key code data corresponding to the depressed keys of LK 14.

(21) Key code buffer for PK: PKBUF

This is a register for a single tone (note) for storing key code data corresponding to the depressed keys of PK 16.

(22) LK key depression buffer LNOTE

This is a register for storing 12-bit LK key depression data indicative of the state of key depression on LK 14. The correspondency between "12" bits and "12" note names is similar to that shown earlier with respect to the address data in the chord table 26.

(23) PK key depression buffer PNOTE

This is a register for storing 12-bit PK key depression data indicative of the state of key depression on PK 16. The relevancy between "12" bits and "12" note names is similar to that for the LK key depression buffer LNOTE.

(24) PK.LK key depression buffer PLNOTE

This is a register to store 12-bit PK.LK key depression data prepared by taking logical sum of the LK key depression data of the key depression buffer LNOTE and the PK key depression data of the key depression buffer PNOTE, for every corresponding bits. The correspondency between the "12" bits and the "12" note names is similar to that for the LK key depression buffer LNOTE.

(25) Note register NT

This is a register for storing note data indicative of the note names detected through the note name detection processing. Each note datum assumes either one or ones of "038 , "1", . . . , "11" corresponding to note names C, C♯, . . . , B, respectively.

(26) Bass flag BSFLG

This is a register for storing 1-bit data indicative of presence or absence of bass progression (walking). In case of no bass progression (generation of the tones of depressed keys on PK), "1" is set, whereas in case of the presence of bass progression (bass pattern is used), "0" is set.

(27) Semitone count (number) register OFST

This register is intended to store semitone count data read out from the conversion table 28 in accordance with type data and pitch data PT.

(28) Tone-production key code buffer KEY

This buffer is to store key code data for controlling LK.TG 36 and PK.TG 38 at the time of bass chord tone production processing.

(29) Key-off counters $KOFCNT_0 \sim KOFCNT_4$

Among these counters, $KOFCNT_0 \sim KOFCNT_3$ correspond to the four (4) tone-producing channels of LK.TG 36, respectively, and $KOFCNT_4$ corresponds to the single tone-producing channel of PK.TG 38. In these respective counters, there are set clock count data corresponding to tone durations. For every interrupt, a down count of "1" is carried out. When the count value reaches "0", the tone which is being produced is suspended of (prohibited from) its pronunciation.

(30) Calculation register TEST

This calculation register is intended to temporarily store the calculation data, result, etc. during various kinds of calculations.

(3l) Key code registers for "non-establishment of chord": $UNDEF_0 \sim UNDEF_5$ These registers are intended to store key code data for six (6) notes at the time of "non-establishment of chord".

(G) Calculation formulas

Several calculation formulas which are used in the series of processing down in FIGS. 9 and onwards are shown below.

(1) a.MOD.b

This formula indicates either to seek the surplus of the division of a value "a" by a value "b" (integral calculation), or the surplus itself obtained.

(2) a.AND.b

This formula indicates either the AND (logical product) calculation of digital data "a" and "b" for every corresponding bits, or the digital data obtained from such calculation.

(3) a.OR.b

This formula indicates either the OR (logical sum) calculation of digital data "a" and "b" for every corresponding bits, or the digital data per se accrued therefrom.

Figure 9:
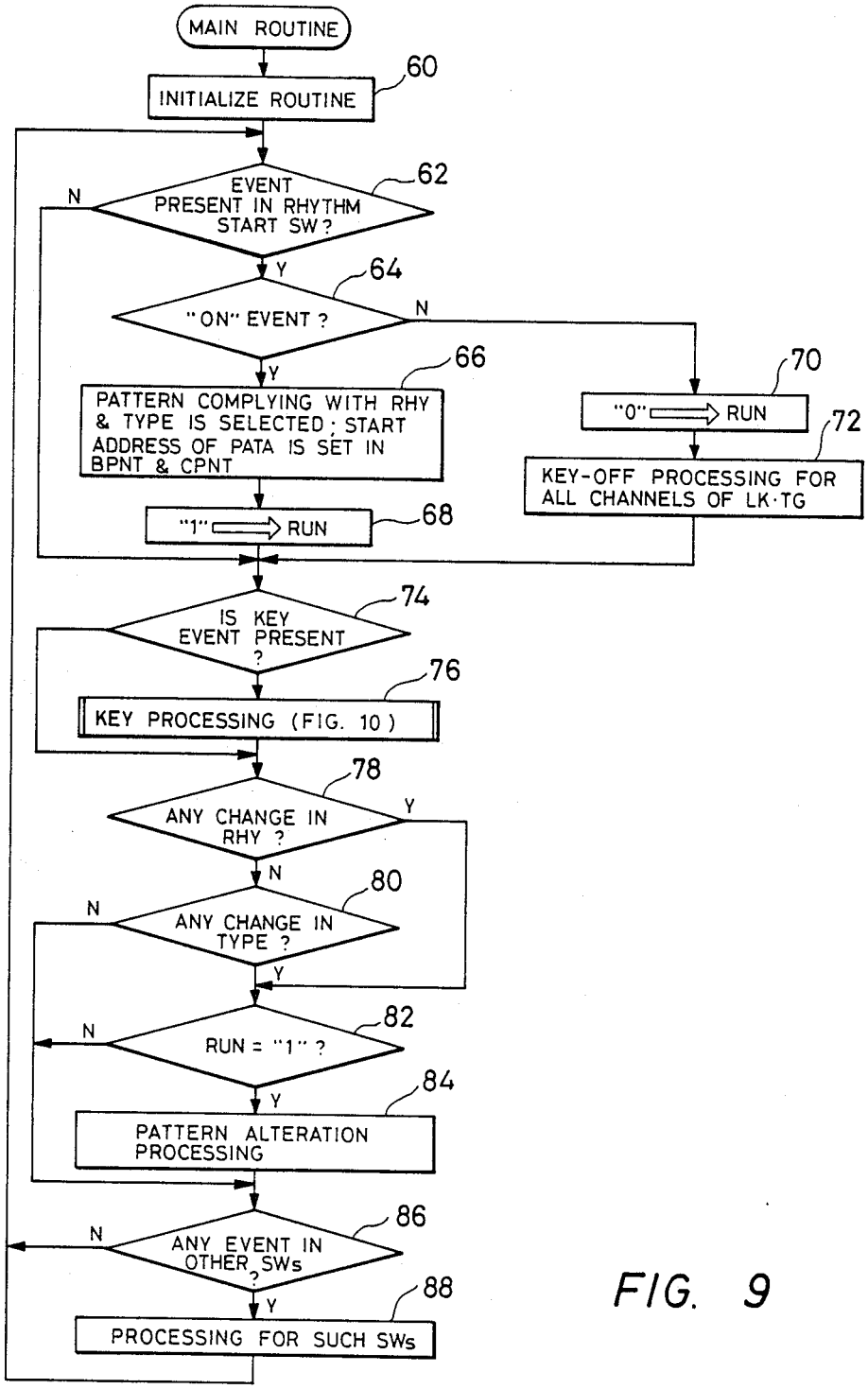
FIG. 9 is a flow chart showing the main routine.

(H) Main routine (FIG. 9)

FIG. 9 shows the main routine, processing. In Step 60, initializing routine is carried out to accomplish initial setting of various registers, etc.

Next, in Step 62, judgment is made whether there is an event ("on" or "off") on the rhythm start switch SW. If there is, (Y), judgment is made in Step 64 whether it is an "on" event. If the result indicates an "on" event, (Y), processing moves to Step 66, wherein bass pattern and chord pattern complying with the rhythm kind of the register RHY and also with the chord type of the register TYPE are selected, and the top addresses of the pattern data PATA for the first bar (measure) of these two kinds of patterns are set in the pointers BPNT AND CPNT, respectively. And, in Step 68, "1" is set in the run flag RUN.

If the result of judgment in Step 64 does not indicate "on" event, (N), this means that the event is an "off" event. Therefore, "0" is set in the run flag RUN in Step 70, and thereafter processing advances onto Step 72. In this Step 72, key-off processing is carried out to render all of the tone-producing channels of LK.TG 36 to the state of suspension of tone production. With this, processing moves to Step 74. It should be noted here that in case the judgment in Step 62 indicates "no event", (N), or in case the processing in Step 68 has ended, processing moves also to Step 74.

In Step 74, judgment is made whether a key event (key depression or key release) has taken place on either one of UK 12, LK 14 and PK 16. If the result of this judgment indicates the presence of a key depression, (Y), processing goes through the key processing sub-routine of Step 76 and then to Step 78. On the other hand, if the result indicates "no key event", (N), processing moves onto Step 78 without going through Step 76. With respect to the key processing sub-routine in Step 76, its description will be made later by referring to FIG. 10.

In Step 78, judgment is made whether there is any change in the rhythm kind of the register RHY. If there is no change, (N), processing moves to Step 80, and if there is, (Y), processing moves onto Step 82.

In Step 80, judgment is made whether there is a change in the chord type of the register TYPE. If yes, (Y), processing moves to Step 82. In this Step 82, judgment is made whether the run flag RUN indicates "1" (rhythm is running), and if "1" is indicated, processing moves to Step 84.

In Step 84, pattern alteration processing is carried out. That is, bass pattern and chord pattern complying with the contents of the registers RHY and TYPE, respectively, are selected, and along therewith, based on the bar counter BAR, the tempo clock counter CLK, etc., detection is made as to: which one of the bass chord timings (which one of the timings "0"~11") for which one of the beats in which one of the bars; and reading-out address is set in the pointers BPNT and CPNT to read out from the event data corresponding to the next timing (e.g. if the detected timing is "5", the next timing is "6"). With this, processing moves to Step 86. It should be noted here that in case the judgment in Step 80 indicates "no change in chord type", (N), or in case the judgment in Step 82 indicates that RUN is not "1", (N), processing moves likewise to Step 86.

In Step 86, judgment is made whether there is an event in the respective kinds of switches other than the rhythm start switch, key switches and rhythm kind selection switches. If there is no event, (N), processing returns to Step 62. If there is an event, (Y), processing complying with the switch bearing an event (e.g. if an event has taken place on the tone color selection switch the tone color alteration processing) is carried out, and then processing returns to Step 62.

Figure 10:
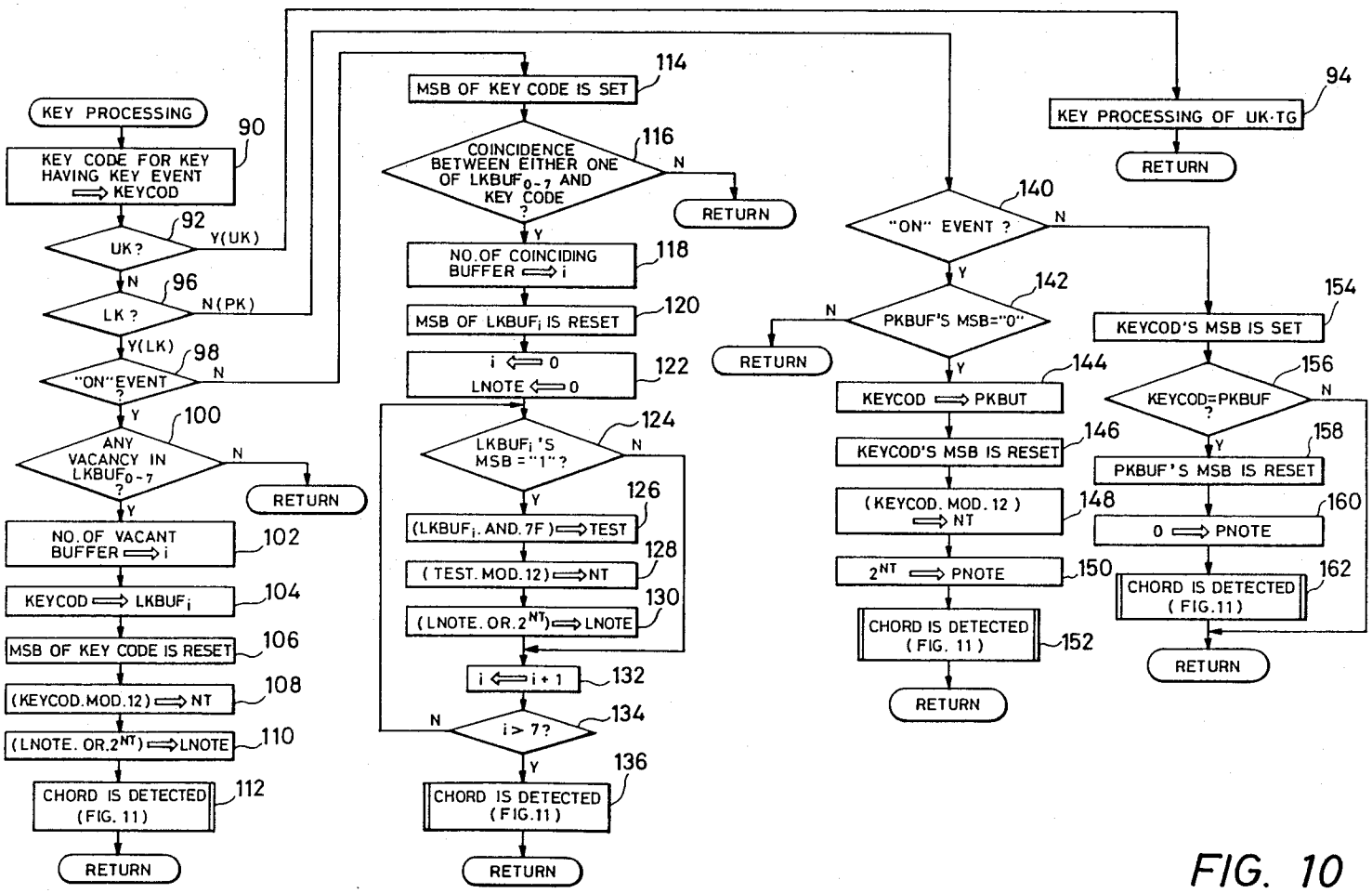
FIG. 10 is a flow chart showing the key processing sub-routine.

(I) Key processing sub-routine (FIG. 10)

FIG. 10 shows the key processing sub-routine. To begin with, in Step 90, a key code data corresponding to the key having a key event is stored in the register KEYCOD. In such a case, it should be noted that while the key code data is comprised of eight (8) bits, the most significant bit MSB thereof is always "0", and thus arrangement is provided so as to indicate the event kind ("on" or "off") by using this MSB. That is, MSB is set to "1" in case of an "on" event (key depression), whereas for an "off" event (key release), it is set to "0".

Next, in Step 92, judgment is made whether the key event has taken place on UK 12. If the result of this judgment is affirmative, (Y), processing moves over to step 94. In this Step 94, a key processing of UK.TG 34 is carried out. If an "on" event, its corresponding musical tones are generated, whereas in case of an "off" event, its corresponding musical tones are rendered to being suspended of their pronunciation. Subsequent thereto, processing returns to the main routine of FIG. 9.

In case the result of judgment in Step 92 is negative, (N), processing moves over to Step 96, wherein judgment is made whether the key event has occurred on LK 14. If the result of this judgment is affirmative, (Y), processing moves to Step 98, wherein judgment is made whether the event has been an "on" event.

Let us now assume that the event has been an "on" event, (Y), then processing moves to Step 100, wherein judgment is made which one or ones of the buffers $LKBUF_0 \sim LKBUF_7$ is or are vacant. If the result of this judgment indicates that there is no vacancy, (N), processing returns to the main routine of FIG. 9. If, however, there is found a vacant buffer, (Y), processing moves onto Step 102, wherein the number of the unoccupied buffer is set as a control variable "i".

Next, in Step 104, the data of the register KEYCOD is written in the first buffer $LKBUT_i$. With this, processing moves to Step 106, wherein MSB of the data of he register KEYCOD is reset to "0". This is for the reason that, in case MSB remains to be "1" (corresponding to an "on" event), the detection of note name in the next Step 108 becomes impossible.

In Step 108, the key code value of the register KEYCOD is divided by "12" (integral calculation) to seek the surplus thereof, thereby the note name is detected, and the note name datum thus obtained is stored in the register NT. For example, if the key code value is "48", the surplus is "0". Therefore, the note name datum indicative of the note name "C" is stored in the register NT. Thereafter, processing moves to Step 110.

In Step 110, out of the "12" bits of the buffer LNOTE, the bit corresponding to the detected note name is set to "1". That is, if the value of the register NT is assumed here to be "NT", such "12"-bit data wherein only the $2^{NT}$-th figure is "1" and the data of the buffer LNOTE are OR'ed for every corresponding bits, and the resulting data is stored in the buffer LNOTE. In the abovementioned example of "NT" value ="0", LSB (corresponding to note name "C") of the buffer LNOTE becomes "1". Thereafter, processing moves to Step 112.

In Step 112, chord detection processing is carried out. This processing will be described later by referring to FIG. 11. Subsequent to Step 112, processing returns to the main routine of FIG. 9.

In case the judgment in Step 98 indicates that the event is not an "on" event, (N), this means that it is an "off" event. Therefore, processing moves to Step 114. In this Step 114, MSB of the register KEYCOD is set to "1". This is for the purpose of enabling the judgment to be made in the next Step 116 as to whether there is an identical key code datum.

In Step 116, judgment is made whether there is a coincidence between either one of the data of the buffers $LKBUF_0 \sim LKBUF_7$ and the data of the register KEYCOD. If non-coincident, (N), processing returns to the main routine of FIG. 9. This is for the reason that, since no key code for "off" event has been set in the buffers $LKBUK_0 \sim LKBUF_7$, there is no need to carry out such processing as the one described below to renew the data of the buffer LNOTE.

In case the result of judgment in Step 116 is affirmative, (Y), processing moves onto Step 118, wherein the buffer number indicating coincidence of key code is set as a control variable "i". And, in Step 120, MSB of the "i-th" buffer LKBUFi among the buffers $LKBUF_0 \sim LKBUF_7$ is reset to "0". This is a processing for the presence of an "off" event.

Next, in Step 112, the control variable "i" is rendered to "0", and along therewith, "0" is set in the buffer LNOTE (all of the "12" bits are set to "0"). On the other hand, in Step 124, judgment is made whether MSB of the buffer $LKBUF_i$ is "1" ("on" event). If an "on" event, (Y), processing moves to Step 126.

In Step 126, the data of the buffer LKBUFi and the data (01111111) for "7F" in hexadecimal notation are AND'ed for every corresponding bits, to thereby obtain a key code datum whose MSB is "0", and this datum is stored in the register TEST. And, in Step 128, in a manner similar to that in the above-described Step 108, note name is detected based on the datum of the register TEST, and the numerical value corresponding to the detected note name is set in the register NT. Thereafter, in Step 130, in a manner similar to that in the above-mentioned Step 110, the specific bit, among the "12" bits of the buffer KNOTE, which corresponds to the detected note name is rendered to "1".

When the series of processing through Steps 124~130 are carried out with respect to "i"="0", that specific bit, among the "12" bits of the buffer LNOTE, which corresponds to the note name detected from the buffer $LKBUF_0$ is set to "1".

Conversely thereto, if MSB of the buffer $LKBUF_0$ is "0", the result of judgment in Step 124 becomes negative, (N), so that the processing through Steps 126~130 is not carried out. Accordingly, if the buffer whose MSB has been rendered to "0" in Step 120 is, for example, $LKBUF_0$, then that bit among the "12" bits of the buffer LNOTE which has the same note name as for $LKBUF_0$ is left in its state of having been rendered to "0".

Subsequent to completion of processing in Step 130, or in case the result of judgment in Step 124 is negative, (N), processing moves to Step 134 after upping the control variable "i" by one (1) in Step 132. In this Step 134, judgment is made whether "i" is greater than "7", and if the result does not indicate $i > 7$, (N), processing returns to Step 124 wherein the above-mentioned processing is repeated until $i > 7$ is acquired. As a result, the contents of the register LNOTE will be rendered to the state that the bit corresponding to the specific note name which has experienced an "on" event is rendered to "0".

When the result of judgment in Step 134 becomes affirmative, (Y), processing moves onto Step 136, wherein chord detection processing is carried out. This processing will be described later. After Step 136, processing returns to the main routine of FIG. 8.

Now, in case the result of judgment in Step 96 is negative, (N), this means that a key event has occurred on PK 16. Therefore, processing moves to Step 140. In this Step 140, judgment is made whether the key event is an "on" event.

Let us here assume that it is an "on" event, (Y). Processing moves onto Step 142, wherein judgment is made whether MSB of the buffer PKBUF is "0" (whether PKBUF is vacant). If the result of this judgment does not indicate MSB ="0", (N), processing returns to the main routine of FIG. 9. If, however, MSB ="0", (Y), processing moves to Step 144.

In Step 144, the data of the register KEYCOD is written in the buffer PKBUF. And, after resetting MSB of the data of the register KEYCOD to "0", processing moves onto Step 148, wherein in a manner similar to that described above in connection with Step 108, processing moves to Step 148, wherein, in a manner similar to that of the above-mentioned step 108, note name is detected based on the data of the register KEYCOD, and the numerical value for this detected note name is set in the register NT. Subsequent thereto, in Step 150, that bit corresponding to the detected note name among the "12" bits of the buffer PNOTE is rendered to "1". That is, if the value of the register NT is assumed here to be "NT", the "12" bits datum whose $2^{NT}$-th figure alone is "1" is stored in the buffer PNOTE.

Next, in Step 152, chord detection processing is carried out. This processing will be described later. Subsequent to Step 152, processing returns to the main routine of FIG. 9.

In case the judgment in Step 140 does not indicate an "on" event, (N), this means that the event is an "off" event, so that processing moves to Step 154. In this Step 154, MSB of the datum of the register KEYCOD is set to "0", and thereafter processing moves to Step 156.

In Step 156, judgment is made whether the datum of the register KEYCOD is coincident with the datum of the buffer PKBUF. If the result indicates "non-coincidence", (N), processing returns to the main routine of FIG. 9. If the result indicates "coincidence", (Y), processing moves to Step 158.

In Step 158, MSB of the datum of the buffer PKBUF is reset to "0". And, in Step 160, "0" is set in buffer PNOTE (all of the "12" bits are set to "0").

Thereafter, in Step 162, chord detection processing is carried out. This processing will be described below. After Step 162, processing returns to the main routine of FIG. 9.

Figure 11:
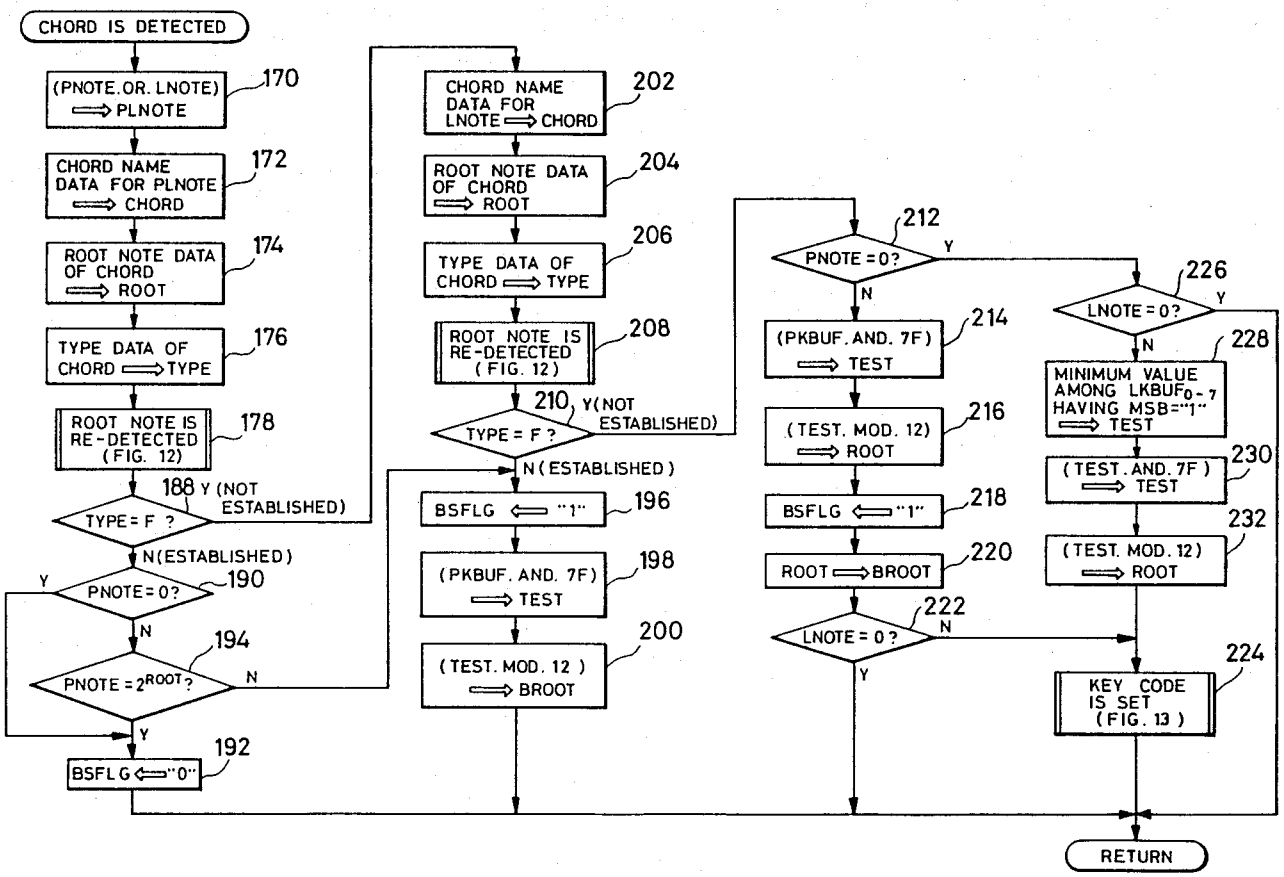
FIG. 11 is a flow chart showing the chord detection sub-routine.
Figure 12:
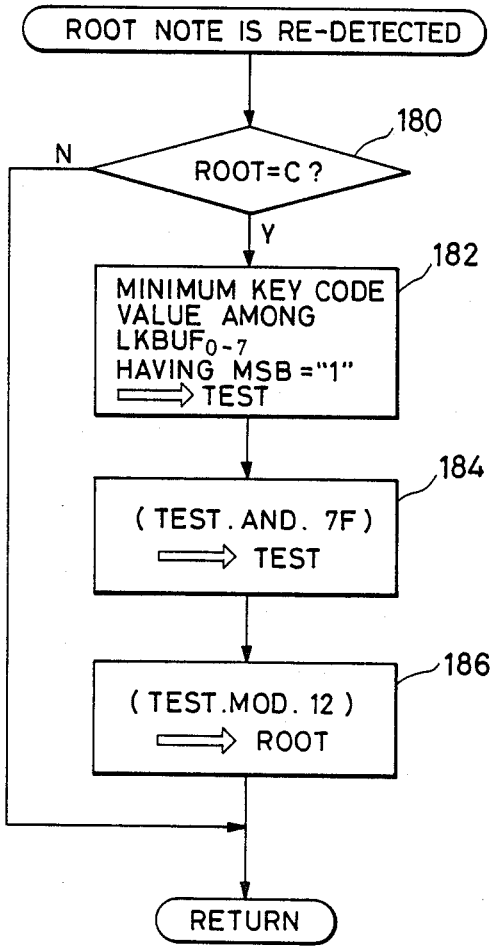
FIG. 12 is a flow chart showing the root note reexamination sub-routine.

(J) Chord detection sub-routine (FIGS. 11 and 12)

FIG. 11 shows the chord detection sub-routine. In Step 170, the datum of the buffer PNOTE and the datum of the buffer LNOTE are OR'ed for every corresponding bits, and the resulting datum obtained is stored in buffer PLNOTE. This processing is intended to render the chord detection feasible which is to be done based on the key depression information on LK 14 and PK 16. And, in Step 172, chord name datum is read out from the chord table 26, using the datum of the buffer PLNOTE as the address datum, and this read-out datum is written in the register CHORD.

Next, in Step 174, the more significant four (4) bits among those bits stored in the register CHORD, i.e. root note datum, are written in the register ROOT, and thereafter processing moves onto Step 176. In this Step 176, the less significant four (4) bits among those bits stored in the register CHORD, i.e. type datum, are loaded in the register TYPE. With this, processing moves onto Step 178.

In Step 178, root note re-detection processing as shown in FIG. 12 is carried out. In FIG. 12, it should be noted that, in Step 180, judgment is made whether the value of the register ROOT is "C" in hexadecimal notation, i.e. whether the root note is indefinite. And, if not indefinite, (N), processing returns to the routine of FIG. 11. Whereas, if indefinite, (Y), processing moves to Step 182.

In Step 182, detection is made of such key code datum where MSB ="1" and key code value is minimum, among the buffers $LKBUF_0 \sim LKBUF_7$, and such a key code datum is written in the register TEST. This processing is intended to render the key of the lowest pitch level among those keys depressed on LK 14 to serve as the root note in case root note is not definite.

Next, in Step 184, in a manner similar to that in Step 126 of FIG. 10, MSB of the key code datum of the register TEXT is rendered to "0". And, in Step 186, in a manner similar to that in Step 128 of FIG. 10, note name is detected based on the datum of the register TEST, and the numerical value corresponding to such note name is written in the register ROOT. Thereafter, processing returns to the routine of FIG. 11.

In FIG. 11, it should be noted that, in Step 188, judgment is made whether the value of the register TYPE is "F" in hexadecimal notation, i.e. whether "chord is not established". If the result of this judgment indicates "chord is established", (N), processing moves to Step 190 wherein judgment is made whether the buffer PNOTE is "0" (whether there has been no key depression on PK).

In case the result of judgment in Step 190 is affirmative, (Y), this means that there has been no key depression on PK 16, so that processing moves to Step 192. In this Step 192, "0" is set in flag BSFLG to make the use of the bass pattern feasible. With this, processing returns to the routine of FIG. 10.

In case the result of judgment in Step 190 is negative, (N), this means that there has taken place a key depression on PK 16, and processing moves to Step 194. In this step 194, judgement is made whether there is coincidence in note name between the depressed key on PK and the root note. More particularly, let us here suppose that the value of the register ROOT is "ROOT". Judgment is then made whether there is coincidence between 12-bit datum where only the $2^{ROOT}$-th figure is "1" and the 12-bit datum of the buffer PNOTE. If the result is indicative of coincidence therebetween, (Y), processing passes through Step 192 as in the above-mentioned case, and then it returns to the routine of FIG. 10. On the other hand, in case of non-coincidence, (N), processing moves to Step 196.

In Step 196, "1" is set in flag BSFLG to enable the generation of the tone of the depressed key on PK. And, in Step 198, in a manner similar to that of the above-described Step 184, MSB of the datum of the buffer PKBUF is rendered to "0" and it is written in the register TEST. Thereafter, in Step 200, in a manner similar to that of the above-stated Step 186, note name is detected based on the datum of the register TEST, and the numerical value corresponding to the detected note name is loaded to the register BROOT. As a result, it becomes possible to generate the tone of the depressed key on PK at the time of non-coincidence in note name between the depressed key on PK and the root note. After Step 200, processing returns to the routine of FIG. 10.

Now, in case the judgment in Step 188 indicates "non-establishment of chord", processing moves onto Step 202. In this Step 202, chord name data is read out from the chord table 26, using the datum of the buffer LNOTE as the address datum, and this read-out datum is written in the register CHORD. And, after setting the root note datum of the register CHORD in the register ROOT in Step 204, the type datum stored in the register CHORD is set in the register TYPE in Step 206.

Next, in Step 208, root note re-detection processing of FIG. 12 is carried out in the same manner as that described above. In Step 210, in a manner similar to that of the above-described Step 188, judgment is made whether a chord is not established. If a chord is established, (N), processing through Steps 196~200 is carried out in a manner similar to that stated above. With this, processing returns to the routine of FIG. 10. Also, in case of "non-establishment of chord", (Y), processing moves onto Step 212.

In Step 212, judgment is made whether the value of the buffer PNOTE is "0", i.e. whether there is no key depression on PK. If the result of this judgment is negative, (N), processing moves to Step 214, wherein in a manner similar to that of the above-described Step 198, MSB of the datum of the buffer PKBUF is rendered to "0", and it is written in the register TEST. In Step 216, in a manner similar to that of the above-described Step 200, note name is detected based on the datum of the register TEST, and the numerical value corresponding to this detected note name is set in the register ROOT.

Next, in Step 218, in a manner similar to that of the above-stated Step 196, "1" is set in the flag BSFLG. With this, processing moves to Step 220, wherein the datum of the register ROOT is written in the register BROOT. As a result, it becomes possible to generate the tone of the depressed key on PK when a chord is not established.

Thereafter, in Step 222, judgment is made whether the value of the buffer LNOTE is "0", i.e. whether there has been no key depression on LK. If the result of this judgment is affirmative, (Y), processing returns to the routine of FIG. 10. Also, in case the result of this judgment is negative, (Y), key code setting processing is carried out in Step 224 and then processing returns to the routine of FIG. 10. The processing in Step 224 will be described later by referring to FIG. 13.

On the other hand, in case the judgment in Step 212 indicates "no key depression on PK", (Y), judgment is made in Step 226 in a manner similar to the above-described Step 222 whether there has been no key depression on LK. If the result of this judgment is affirmative, (Y), this means that there has been no key depression not only on PK but also on LK. Thus, the processing returns to the routine of FIG. 10.

In case the result of judgment in Step 226 is negative, (N), processing moves onto Step 228, wherein, in a manner similar to that of the above-described Step 182, a key code datum corresponding to the lowest-pitched note among those depressed keys on LK is set in the register TEST. And, after rendering MSB of the datum of the register TEST to "0" in Step 230 in a manner similar to that of the above-described Step 184, note name is detected based on the datum of the register TEST in Step 232 in a manner similar to that of the above-stated Step 186, and a numerical value corresponding to the detected note name is set in the register ROOT. Thereafter, processing moves onto Step 224, wherein key code setting sub-routine which will be described below is carried out, and then processing returns to the routine of FIG. 10.

(K) KEY CODE SETTING SUB-ROUTINE (FIG. 13)

Figure 13:
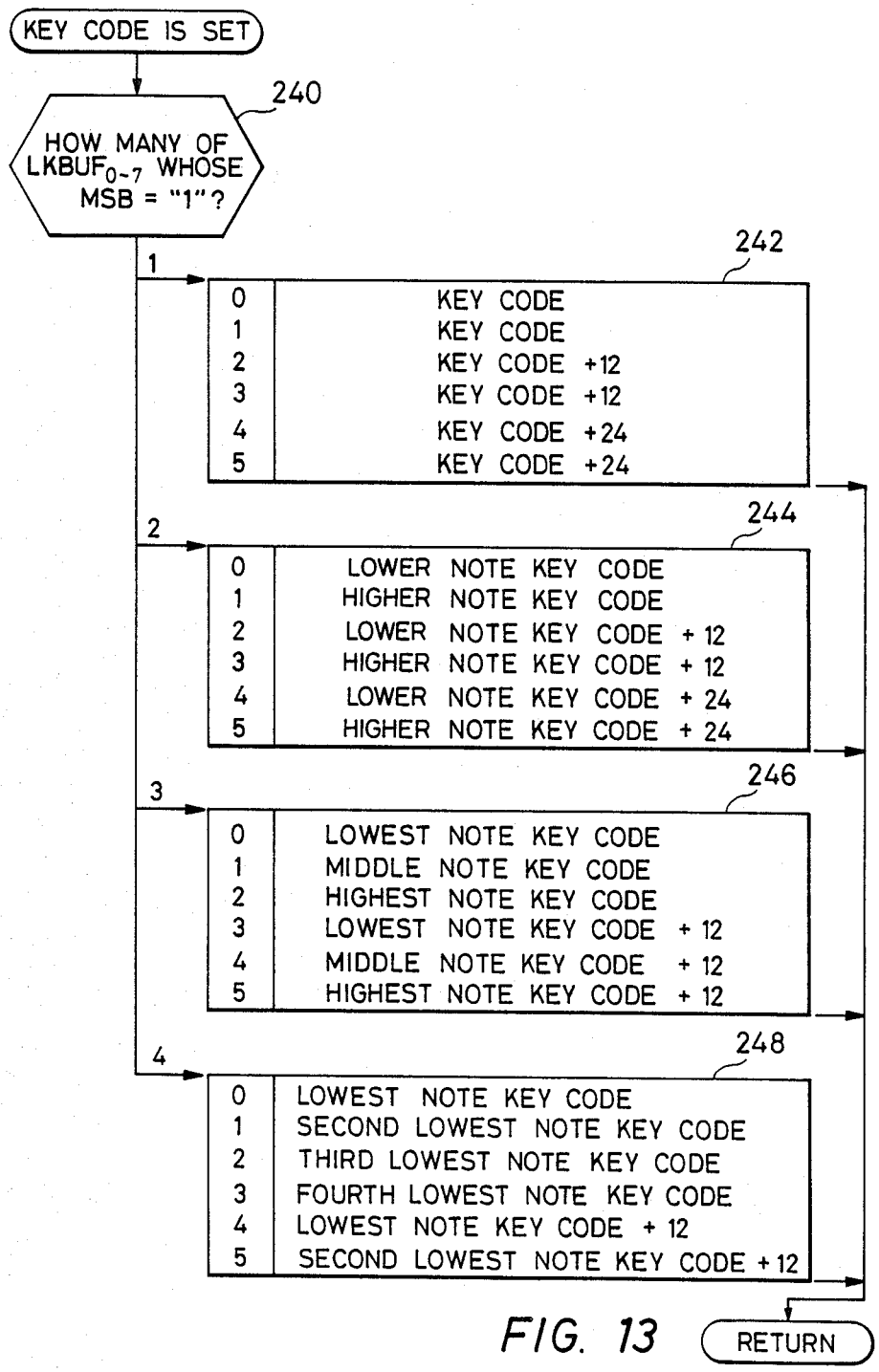
FIG. 13 is a flow chart showing the key code setting sub-routine for non-establishment of chord.

In FIG. 13, it should be noted that, in Step 240, judgment is made how many of the buffers $LKBUF_0 \sim LKBUF_7$ indicate MSB ="1". In case the result of this judgment shows that there is one (1), processing moves to Step 242, and if there are two (2), processing moves over to Step 244, and if there are three (3), to Step 246, whereas if there are four (4) or more, to Step 248. These Steps 242~248 are invariably intended to carry out the processing of storing key code data for six (6) tones (notes) in the registers $UNDEF_0 \sim UNDEF$, respectively. Upon completion of the processing in either one of these Steps, processing returns to the routine of FIG. 11.

In Step 242, a key code value of such a buffer having MSB ="1" is set in those UNDEF's whose own numbers are "0" and "1", and "said key code value +12" (one-octave-higher value) is set in No. 2 and No. 3 UNDEFs, while "such key code value +24" (two-octave-higher value) is set in No. 4 and No. 5 UNDEFs, respectively.

In Step 244, a key code value for a lower note and that for a higher note among those two buffers having MSB ="1" are set in No. 0 and No. 1 UNDEFs, respectively, and "said lower note key code value +12" and "said higher note key code value +12" are set in No. 2 and No. 3 UNDEFs, respectively, while "said lower note key code value +24" and "said higher note key code value +24" are set in No. 4 and No. 5 UNDEFs, respectively.

In Step 246, key code values for the lowest note, the middle note and the highest note among those three (3) buffers having their MSB ="1" are set in No. 0, No. 1 and No. 2 UNDEFs, respectively, while "said lowest note key code value +12", "said middle note key code value +12" and "said highest note key code value +12" are set in No. 3, No. 4 and No. 5 UNDEFs, respectively.

In Step 248, key code values for the lowest note, the next lowest note, the third lowest note and the fourth lowest note in those four (4) or more buffers each having MSB ="1" are set in No. 0, No. 1, No. 2 and No. 3 UNDEFs, respectively, whereas "said lowest note key code value +12" and "said next lowest note key code value +12" are set in No. 4 and No. 5 UNDEFs, respectively.

It should be noted here that the determination to generate musical tones in compliance with the data of which one or ones of the registers among those $UNDEF_0 \sim UNDEF_5$ having been set with key code values for six (6) tones in either one of the above-described Steps is made by the pitch datum PT (either one of the values "0"~"5") contained in the chord pattern for "non-establishment of chord".

Figure 14:
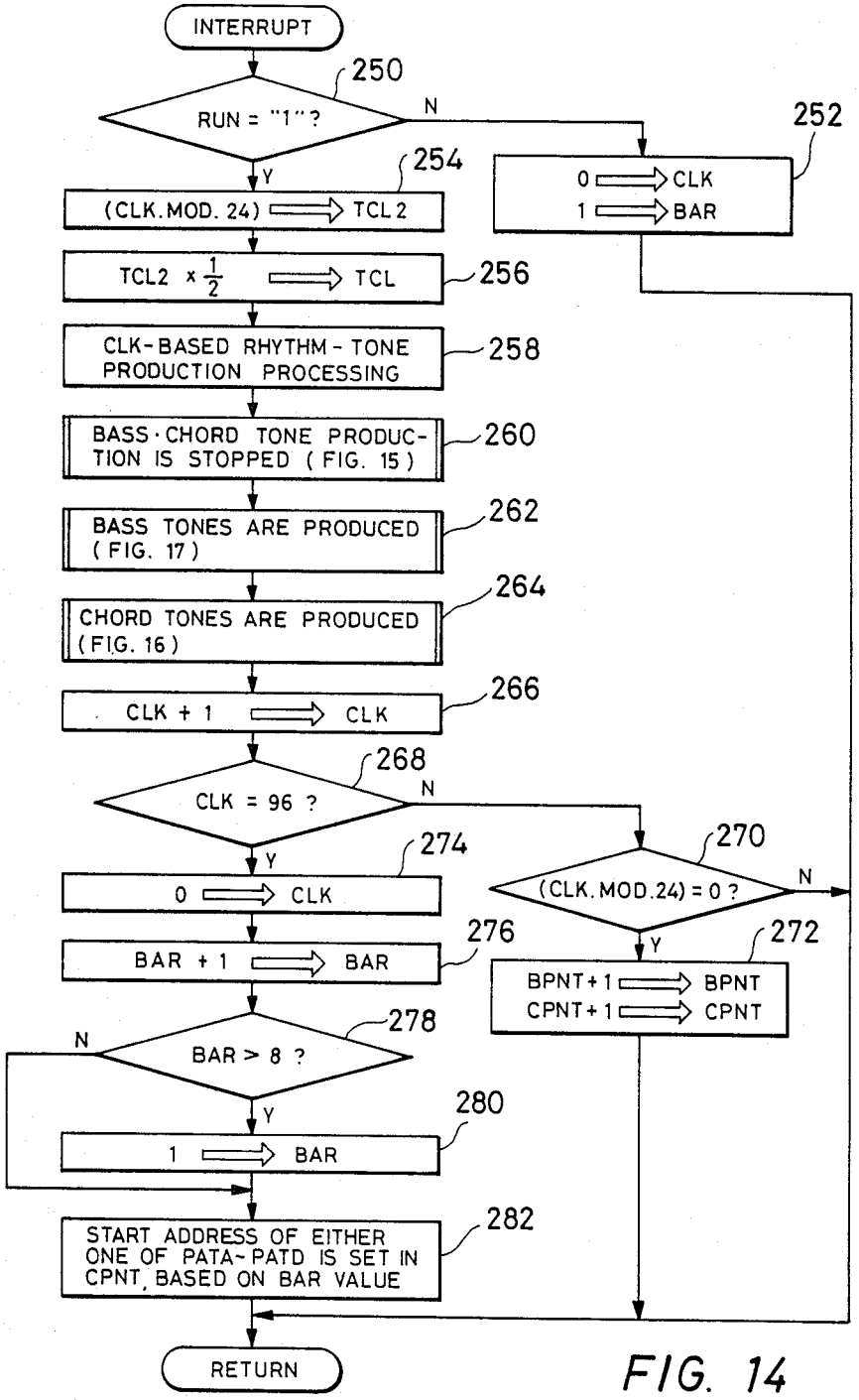
FIG. 14 is a flow chart showing the interrupt routine.

(L) Interrupt routine (FIG. 14)

FIG. 14 shows the interrupt routine for realizing automatic rhythm performances as well as automatic bass chord performances. This routine is carried out for every generation of a tempo clock pulse from the tempo clock generator 32.

To begin with, in Step 250, judgment is made whether the flag RUN is "1" (rhythm is running). If the result of this judgment is negative, (N), "0" is set in the couter CLK and "1" is set in the counter BAR in Step 252, and thereafter processing returns to the main routine of FIG. 9. In case the result of the judgment is affirmative, (Y), processing moves onto Step 254.

In Step 254, processing to set intra-beat timings is carried out. More particularly, the surplus (either one of "0"~"23") obtained by dividing the count value of the counter CLK by "24"(integral calculation) is set in the register $TCL_2$. With this, processing moves to Step 256.

In Step 256, processing to set bass chord timing is carried out. That is, the value of the register $TCL_2$ is multiplied by "½" and the resulting value is set in the register TCL.

Next, in Step 258, rhythm tone production processing is carried out in accordance with the value of the counter CLK. Description of this processing is omitted here. Subsequent thereto, in Step 260, bass chord tone production suspension sub-routine is carried out as will be described later by referring to FIG. 15. In Step 262, bass tone production sub-routine is carried out as will be described later also by referring to FIG. 17. In Step 264, chord tone production sub-routine is carried out as will be described later by referring to FIG. 16. With this, processing moves to Step 266.

In Step 266, the count value of the counter CLK is upped by one (1). With this, processing moves to Step 268, wherein judgment is made whether the count value of the counter CLK is "96" (end of one bar). If the result of this judgment is negative, (N), processing moves to Step 270.

In Step 270, by the calculation similar to that in the above-mentioned Step 254, intra-beat timing value is sought, and judgment is made whether this intra-beat timing value is "0" (end of one beat), and if the result of this judgment is negative, (N), processing returns to the main routine of FIG. 9. Also, if the result is affirmative, (Y), the values of the pointers BPNT and CPNT are upped by one (1), respectively, and processing returns to the main routine of FIG. 9. By virtue of this processing in Step 272, it becomes possible at the next interrupt to read out next event datum relative to the beat-end data BE.

In case the result of judgment in Step 268 is affirmative, (Y), the count value of the counter CLK is rendered to "0" in Step 274, and thereafter the count value of the counter BAR is upped by one (1) in Step 276. And, in Step 278, judgment is made whether the count value of the counter BAR is greater than "8" (end of 8-th bar). If the result of this judgment is affirmative, (Y), the count value of the counter BAR is rendered to "1" in Step 280, and then processing moves to Step 282. In case the result of judgment is negative, (N), processing skips the Step 280 and moves directly to Step 282.

In Step 282, the start address of either one of the pattern data PATA~PATD is set in the pointers BPNT and CPNT based on the count value of the counter BAR. That is, in case the value of the counter BAR is "1", "3", "5" or "7", the start address of PATA is set, whereas in case the value is "2" or "6", the start address of PATB is set, while in case of "4", the start address of PATC is set, and in case of "8", the start address of PATD is set. Thereafter, processing returns to the main routine of FIG. 9.

Figure 15:
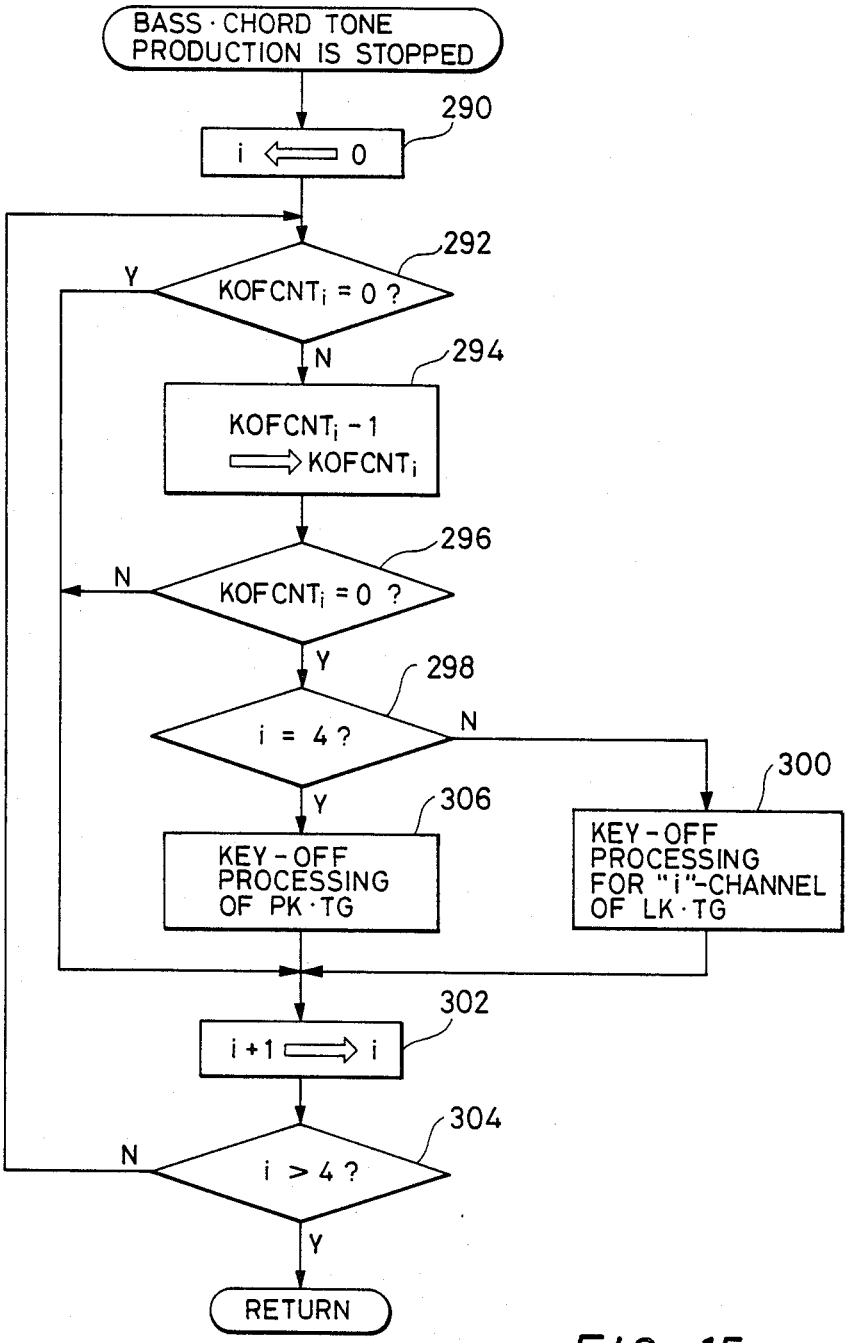
FIG. 15 is a flow chart showing the bass chord tone production suspension sub-routine.

(M) Bass chord tone production suspension sub-routine (FIG.15)

In FIG. 15, it should be noted that, in Step 290, "0", is set as the control variable "*i*". And, in Step 292, judgment is made whether the count value of the "i"-th counter $KOFCNT_i$ among those counters $KOFCNT_0$-

$\sim$KOFCNT$_4$ is "0" (end of note duration). If the result of this judgment is negative, (N), processing moves to Step 294.

In Step 294, the count value of the counter KOFCNT$_i$ is downed by one (1). With this, processing moves to Step 296, wherein judgment is made whether the count value of the counter KOFCNT$_i$ is "0" (end of tone duration). If the result of this judgment is affirmative, (Y), processing moves to Step 298, wherein judgment is made whether "i" is "4". Since "i"="0" initially, the result of judgment in Step 298 becomes negative, (N). With this, processing moves to Step 300.

In Step 300, key-off processing is carried out to render the "i"-th tone-producing channel of the LK.TG 36 to the state of suspension of tone production. And, "i" is upped by one (1) in Step 302.

If the result of judgment in Step 292 is affirmative, (Y), processing moves to Step 302.

If the result of judgment in Step 292 is affirmative, (Y), processing moves over to Step 302. Also, in case the result of judgment in Step 296 is negative, (N), processing moves likewise to Step 302. This is because, in these cases, key-off processing is not required.

After rendering "i" from "0" to "1" in Step 302, judgment is made whether "i">"4" in Step 304. The result of this judgment becomes negative, (N), so that processing returns to Step 292. And, such series of processing as stated above are repeated for each of the following cases wherein "i" is "1", "2" and "3".

When "i" shifts from "3" to "4" in Step 302, processing passes through Step 304 and returns to step 292. And, in case the result of judgment in Step 292 is negative, (N), and in addition when the result of judgment in Step 296 is affirmative, (Y), the result of judgment in Step 298 becomes affirmative, (Y), since "i"="4" in this Step. With this, processing moves to Step 306.

In Step 306, key-off processing is carried out to render the single tone-producing channel of the PK.TG 38 to the state of suspended tone production. And, after shifting "i" from "4" to "5" in Step 302, judgment is made whether "i">"4" in Step 304.

The result of this judgment becomes affirmative, (Y). With this, processing returns to the routine of FIG. 14.

(N) Chord tone production sub-routine (FIG. 16)

In FIG. 16, it should be noted that, in Step 310, judgment is made whether the value of the buffer LNOTE is "0" (no key depression on LK). If the result of this judgment is affirmative, (Y), processing returns to the routine of FIG. 14. If the result of judgment is negative, (N), processing moves onto Step 312.

In Step 312, the data of the chord pattern $P_C$ is read out based on the address value of the pointer CPNT. In this case, for the event datum EVT$_C$, two-byte data is read out. The tone volume datum LV is set in the register LVR, the timing datum TIM is set in the register TIMR, the tone duration datum LEN is set in the register LENR, the channel datum CH is set in the register CHR, and the pitch datum PT is set in the register PTR. Also, with respect to either the beat-end datum BE or the bar-end datum ME, one-byte data is read out, and its lesser significant four (4) bits ("1110" or "1111") are stored in the register TIMR.

Next, in Step 314, judgment is made whether there is coincidence (timing for tone production) between the value of the register TCL (i.e. bass chord timing) and the value of the register TIMR. In this case, it should be noted that, if the timing datum TIM has been stored in the register TIMR and that if this register's value is equal to the value of the register TCL, the result of judgment becomes affirmative, (Y), and processing moves to Step 316. Also, in case the value of the timing datum TIM is not equal to the value of the value of TCL, or in case the less significant four (4) bits of either the beat-end datum BE or the bar-end datum ME have been stored in the register TIMR, the result of judgment becomes negative, (N), and processing returns to the routine of FIG. 14.

In Step 316, judgment is made whether the value of the register TYPE is "F" in hexadecimal notation (chord is not established). If the result of this judgment is negative, (N), processing moves onto Step 318. In this Step 318, semitone count data is read out from the conversion table 28 based on the pitch data of the register TYPE, and this read-out data is written in the register OFST. On the other hand, in Step 320, the value of the register ROOT is added with the value of the register OFST, and the resulting key code datum is stored in the buffer KEY.

In case the result of judgment in Step 316 is affirmative, (Y), this means that chord has not been established, so that processing moves onto Step 322. In this Step 322, among the registers UNDEF$_0\sim$UNDEF$_5$, the key code datum of that UNDEF corresponding to the value (either one of the pitch levels "0"$\sim$"5") of the register PTR is written in the buffer KEY.

Subsequent to Step 320 or Step 322, processing moves onto Step 324, wherein clock count datum is read out from the conversion table 28 based on the datum of the register LENR, and same is stored in the register CNR. On the other hand, in Step 326, the value of the register CNR is set in that counter KOFCNT among those counters KOFCNT$_0\sim$KOFCNT$_3$ which corresponds to the value (channel number) of that register CHR. As a result, the down-count in Step 294 of FIG. 15 is made feasible.

Next, in Step 328, key-on processing of LK.TG 36 is carried out. That is, key-code data of the buffer KEY is supplied to that tone-producing channel, among the four (4) tone-producing channels of LK.TG 36, which corresponds to the value of the register CHR, thereby the production of the musical tones corresponding to said key code data is started. The tone volume (loudness level) of the musical tones obtained at such a time is controlled in accordance with the tone volume data LV of the register LVR.

Thereafter, processing moves over to step 330, wherein the value of the pointer CPNT is upped by two (2). This is based on the consideration that the event data EVT$_C$ is constructed with two (2) bytes. Subsequent to Step 330, processing returns to Step 312, and the series of processing mentioned above are repeated. As a result, it is made possible to realize simultaneous production of tones up to a maximum of four (4) tones.

(O) Bass tone production sub-routine (FIG. 17)

In FIG. 17, it should be noted that, in Step 340, judgment is made whether the value of the buffer PNOTE is "0" (no key depression on PK). If the result of this judgment is affirmative, (Y), processing returns to the routine of FIG. 14. On the other hand, if the result of judgment is negative, (N), processing moves onto Step 342.

In Step 342, in a manner similar to that of the above-described Step 312, the data of the bass pattern PB is read out, and data related to the registers LVR, TIMR, LENR and PTR, respectively, is stored therein respectively. With this, processing moves onto Step 346, wherein, in a manner similar to that of the above-described Step 314, judgment is made whether there is coincidence between the value of the register TCL and the value of the register TIMR. If the result of this judgment is negative, (N), processing returns to the routine of FIG. 14, and if affirmative, (Y), processing moves over to Step 348.

In Step 348, judgment is made whether the flag BSFLG is "0" (whether bass pattern is used). If the result of this judgment is affirmative, (Y), processing moves to Step 350. In this Step 350, in a manner similar to that of the above-described Step 318, semitone count datum is read out from the conversion table 28 based on the data of the register PTR and of the register TYPE, and same is set in the register OFST. In Step 352, on the other hand, in a manner similar to that of the above-described Step 320, the value of the register ROOT is added with the value of the register OFST, and the resulting key code datum is stored in the buffer KEY.

In case the result of judgment in Step 348 is negative, (N), processing moves onto Step 354. In this Step 354, the bass root tone datum is converted to a key code datum corresponding to the depressed key on PK, by adding the numerical value "48" to the value of the register BROOT, and the resulting key code datum is stored in the buffer KEY. As an example, if the value of the register BROOT is "0", the value of he buffer KEY becomes "48", and the tone "$C_2$" can now be sounded out as the bass tone.

After Step 352 or 354, processing moves to Step 356, wherein, in a manner similar to that of the above-described Step 324, clock count datum corresponding to the value of the register LENR is stored in the register CNR. In Step 358, the value of the register CNR is set in the counter KOFCNT4.

Next, in Step 360, key code processing of PK.TG 38 is carried out. That is, by supplying the key code datum of the buffer KEY to the single tone-producing channel of the PK.TG 38, sounding-out of the musical tone corresponding to said key code datum is started. The tone volume of the musical tone at such a time is controlled in accordance with the tone volume (loudness level) datum of the register LVR.

In the above-described embodiment, arrangement is provided so that bass chord patterns are stored in the pattern memory in a number as many as the various kinds of chord types. It should be noted, however, that, apart from the above, arrangement may be made so that the chord types are divided into a plurality of families such as major, minor, and seventh, and that bass chord pattern is stored for every chord type family. By so arranging, the storage capacity of the pattern memory can be reduced.

In the above-described embodiment, one bar is assumed to have four (4) beats (quadruple meter). It is needless to say that time signature may be altered appropriately in accordance with the rhythm kind.

As described above, according to the present invention, arrangement is provided so that judgment is made whether there is coincidence in note name between the depressed key on the pedal keyboard and the root note, and where there is no coincidence therebetween, the tone of the depressed key on the pedal keyboard is generated as the bass tone. Therefore, it is possible to realize non-root-bass chord performances or walking bass performances which are free of discord.

Also, by arranging so that, at the time of nonestablishment of chord, detection of a chord is carried out by relying only on the key depression state of the manual keyboard, it is possible to make tension chord performances also, whereby automatic bass chord performances rich in variation of performance style can be realized.

What is claimed is:

1. An automatic bass chord accompaniment apparatus for an electronic musical instrument, comprising:

a first keyboard having keys for manual operation to perform chord tones and producing first key depression information indicative of depressed keys;

a second keyboard having keys for pedal operation to perform bass tones and producing second key depression information indicative of a depressed key;

first detecting means for detecting a chord type based on the first and second key depression information supplied from said first and second keyboards;

second detecting means for detecting a root note based on the key depression information from at least said first keyboard;

pattern memory means for storing a plurality of chord patterns and bass patterns, said chord patterns and bass patterns being provide differently for different chord types, wherein each chord pattern includes data representing tone pitches and tone-producing timings for chord-constituting tones, and each bass pattern includes data representing tone pitches and tone-producing timings for bass tones;

chord tone generating means for generating chord tones based on a selected chord pattern according to a chord type detected by said first detecting means and a root note detected by said second detecting means;

judging means for judging coincidence in note name between a key depressed on said second keyboard and said detected root note; and bass tone generating means for generating (a) a bass tone based on a selected bass pattern according to said detected chord type and on said detected root note when a coincidence in note name is judged, and (b) a bass tone corresponding to said key depressed on said second keyboard when non-coincidence therebetween is judged.

2. An automatic bass chord accompaniment apparatus according to claim 1, wherein in a situation where non-coincidence in note name is judged, said bass tone generating means generates a bass tone corresponding to said key depressed on said second keyboard at such timings as are indicated by a selected bass pattern corresponding to said detected chord type.

3. An automatic bass chord accompaniment apparatus for an electronic musical instrument, comprising:

a first keyboard having keys for manual operation and producing first key depression information indicative of depressed keys;

a second keyboard having keys for pedal operation and producing second key depression information indicative of a depressed key;

first detecting means for detecting a chord type based on the first and second key depression informations supplied from said first and second keyboards;

second detecting means for detecting a root note based on the key depression information supplied from at least said first keyboard;

third detecting means for detecting a chord type based on the key depression information supplied from said first keyboard only when a chord type is not detected by said first detecting means;

pattern memory means storing a plurality of chord patterns and bass patterns, each of said chord patterns including data representing tone pitches and tone-producing timings for chord-constituting tones, each of said bass patterns including data representing tone pitches and tone-producing timings for bass tones;

chord tone generating means for generating chord tones based on a selected chord pattern according to a chord type detected by said first detecting means, whereas in case a chord type is not detected by said first detecting means, said chord tone generating means generates chord tones based on a selected chord pattern corresponding to a chord type detected by said third detecting means and to root note detected by said second detecting means;

judging means for judging, when a chord type is detected by said first detecting means, coincidence in note name between a key depressed on said second keyboard and said root note detected by said second detecting means; and bass tone generating means for generating a bass tone based on a selected bass pattern according to a chord type detected by said first detecting means and on a root note detected by said second detecting means when a coincidence in note name is judged, and a bass tone corresponding to a key depressed on said second keyboard when non-coincidence in note name is judged by said judging means or when a chord type is not detected by said first detecting means.

* * * * *